US006450411B1

(12) United States Patent
Rash et al.

(10) Patent No.: US 6,450,411 B1
(45) Date of Patent: Sep. 17, 2002

(54) ENVIRONMENTAL STABILIZATION SYSTEM AND METHOD FOR MAINTENANCE AND INVENTORY

(75) Inventors: Christopher K. Rash, Manassas; William J. Lawrence, Spotsylvania; Brian D. Wolfe, Centreville; Holden W. Hewlett, Woodbridge, all of VA (US)

(73) Assignee: Logis-Tech Corporation, Alexandria, VA (US)

( * ) Notice: Subject to any disclaimer, the term of this patent is extended or adjusted under 35 U.S.C. 154(b) by 23 days.

(21) Appl. No.: 09/773,773

(22) Filed: Feb. 2, 2001

(51) Int. Cl.[7] ..... G06F 19/00; B01F 3/02

(52) U.S. Cl. ..... 236/44 A; 236/51; 454/119; 700/108

(58) Field of Search ..... 700/108, 19, 32; 236/51, 94, 44 A; 454/119

(56) References Cited

U.S. PATENT DOCUMENTS

| | | | | | |
|---|---|---|---|---|---|
| 2,293,316 | A | | 8/1942 | Stebbins | 62/257 |
| 2,620,636 | A | | 12/1952 | Stanton | 62/117.15 |
| 3,036,382 | A | | 5/1962 | Shotton, Jr. | 34/48 |
| 3,777,506 | A | | 12/1973 | Hergatt et al. | 62/237 |
| 4,835,977 | A | | 6/1989 | Haglund et al. | 62/89 |
| 4,901,538 | A | | 2/1990 | Anthony | 62/237 |
| 5,721,676 | A | * | 2/1998 | Bolden et al. | 700/108 X |
| 5,798,945 | A | * | 8/1998 | Benda | 340/310.01 |
| 6,269,279 | B1 | * | 7/2001 | Todate et al. | 700/121 |
| 6,332,110 | B1 | * | 12/2001 | Wolfe | 702/22 |

OTHER PUBLICATIONS

Contract No. DAHA90–96–D–0012 awarded by the U.S. National Guard Bureau 1996 (products sold thereunder).
Contract No. DAHA90–98–D–0009 awarded by the U.S. National Guard Bureau, 1998 (products sold thereunder).
Vol. I, Technical Proposal, submitted to National Guard Bureau, 1998 (products sold thereunder).
Environment Stabilization Systems (ESS™), Conserving Critical Resources Through Application of Advanced Technology Developed Under The Small Business Innovation Research Program, Logis–Tech, Inc., 1996.

* cited by examiner

*Primary Examiner*—William Wayner
(74) *Attorney, Agent, or Firm*—Pillsbury Winthrop LLP

(57) ABSTRACT

A system and method for maintaining environmental stabilization. In one embodiment, the system includes one or more controllers that communicate with air dehumidification units to control the relative humidity and temperature within a controlled facility. In another embodiment, a single vehicle environmental stabilization system includes a single vehicle unit attached to each vehicle to control relative humidity within the interior of the vehicle. In these embodiments, the system provides alert messages for out-of-range conditions and tracks and reports related maintenance status to local and remote users using an electronic network. A method of achieving environmental stabilization includes determining the ambient value of a relative humidity level at a site, determining a set of design parameters for an environmental stabilization system, selecting a preferred combination of design parameters and structural modifications, remotely controlling the system, and collecting vehicle maintenance status information using a radio frequency identification system having a portal antenna.

7 Claims, 18 Drawing Sheets

LOGIS TECH Logis -Tech, inc.

LATEST READINGS FOR OBJECT 814 (SHELTER 1)
USAR"

| OBJECT NAME | CHANNEL ID | CHANNEL NAME | LATEST VALUE | DATE |
|---|---|---|---|---|
| SHELTER 1 | 3 | SHELTER RH | 85 | 2001-01-30 15:47:00 |
| SHELTER 1 | 4 | SHELTER T | NO DATA | NO DATA |
| SHELTER 1 | 5 | SHELTER RH | 90 | 2001-01-30 15:46:00 |
| SHELTER 1 | 6 | SHELTER T | NO DATA | NO DATA |
| SHELTER 1 | 7 | PROC OUT TEMP | 81 | 2001-01-30 15:47:00 |
| SHELTER 1 | 8 | PROC OUT RH | NO DATA | NO DATA |
| SHELTER 1 | 9 | REACT OUT TEMP | NO DATA | NO DATA |
| SHELTER 1 | 10 | COMB. FUMES | 3 | 2001-01-30 15:53:00 |

LAST READINGS WERE TAKEN AT 1900-01-01 00:00:00

*Fig. 16*

350
LOGIS TECH Logis -Tech, inc.
CONTROL PARAMETER CHARTS
01/04/2001 TO 02/02/2001
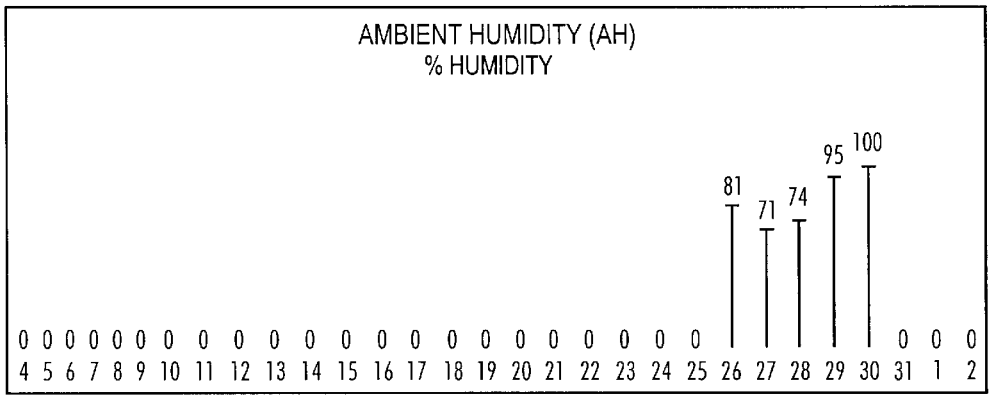
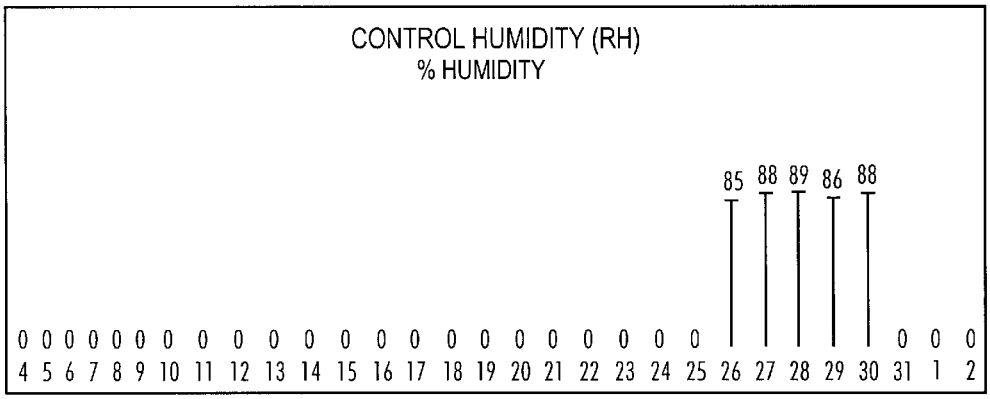
EXCEPTION FOR FORT McCOY USAR - SHELTER
| | | |
|---|---|---|
| 30-JAN-01 | INACTIVE STATUS | SYSTEM REMOVED FROM OPERATIONS BY USER |
| 30-JAN-01 | RH WARNING | |
| 29-JAN-01 | INACTIVE STATUS | SYSTEM REMOVED FROM OPERATION BY USER |
| 29-JAN-01 | RH WARNING | |
| 28-JAN-01 | INACTIVE STATUS | SYSTEM REMOVED FROM OPERATIONS BY USER |
*Fig. 17*

355

LOGIS TECH Logis -Tech, inc.

48 HOURS TREND AT FORT McCLELLEN

OBJECT: OP 2 CHANNEL: 3 (OP 2 UNIT RH)

CONTROL HUMIDITY (RH)
% HUMIDITY

| 11 | 12 | 13 | 14 | 15 | 16 | 17 | 18 | 19 | 20 | 21 | 22 | 23 | 00 | 01 | 02 | 03 | 04 | 05 | 06 | 07 | 08 | 09 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

OBJECT: OP 2 CHANNEL: 5 (OP 2 PROC TEMP)

PROCESS OUT TEMPERATURE (PT)
DEGREES F

| 11 | 12 | 13 | 14 | 15 | 16 | 17 | 18 | 19 | 20 | 21 | 22 | 23 | 00 | 01 | 02 | 03 | 04 | 05 | 06 | 07 | 08 | 09 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|---|---|---|---|---|---|---|---|---|---|---|---|---|---|---|---|---|
| 68 | 72 | 73 | 76 | 74 | 70 | 65 | 56 | 49 | 48 | 47 | 45 | 43 | 42 | 39 | 37 | 35 | 35 | 34 | 33 | 32 | 33 | 38 | 43 | 46 | 54 | 56 | 59 | 58 | 61 | 52 | 46 | 42 | 38 | 36 | 36 |

Fig. 18

GUARDIAN IV - ver. 4.0

FILE SITE DATA MAINTENANCE HELP ALARMS

BLDG KT25 8/20/99 9:02:34 AM

| | | |
|---|---|---|
| 102.528 | AMBIENT TEMPERATURE | CHANNEL OPERATING NORMALLY |
| 46.42 | AMBIENT RH | CHANNEL OPERATING NORMALLY |
| 0 | CONTROL RH 1 | CHANNEL OPERATING NORMAL LIMITS |
| 0 | ADU 1 PROC OUT TEMP | CHANNEL OPERATING NORMAL LIMITS |
| 0 | ADU 1 PROC OUT RH | CHANNEL OPERATING NORMAL LIMITS |
| 0 | ADU 2 PROC OUT TEMP | CHANNEL OPERATING NORMAL LIMITS |
| 0 | ADU 2 PROC OUT RH | CHANNEL OPERATING NORMAL LIMITS |
| 0 | COMB. FUMES | CHANNEL OPERATING NORMAL LIMITS |
| 0 | CONTROL RH 2 | CHANNEL OPERATING NORMAL LIMITS |
| 0 | ADU 1 REACT OUT TEMP | CHANNEL OPERATING NORMAL LIMITS |
| 0 | ADU 2 REACT OUT TEMP | CHANNEL OPERATING NORMAL LIMITS |

*Fig. 19*

ENVIRONMENTAL STABILIZATION SYSTEM AND METHOD FOR MAINTENANCE AND INVENTORY

A portion of this disclosure contains material that is subject to copyright protection. The copyright owner has no objection to the facsimile reproduction by anyone of the patent document or patent disclosure, as it appears in the Patent and Trademark Office file or records, but otherwise reserves all copyright rights whatsoever.

BACKGROUND OF THE INVENTION

1. Field of the Invention

The present invention relates generally to systems and methods used to provide and maintain environment stabilization, and, more specifically, to systems and methods providing environment stabilization of a group of vehicles achieved through structural modifications combined with an environmental stabilization system remotely monitored and controlled using electronic networks.

2. Background

Uncontrolled atmospheric conditions are known to have deleterious effects upon many types of equipment and components during both operation and storage. In particular, extreme relative humidity and temperature levels and variations in these environmental conditions place considerable mechanical stress on components and systems due to, among other things, different moisture absorption rates and thermal expansion coefficients of the various materials of the components used in a given system or piece of equipment. Furthermore, variation in relative humidity and temperature contributes to chemical breakdown of system components, their materials and the bonding of materials therebetween. These effects can significantly impact overall system reliability, availability, life expectancy, maintenance frequency and support costs.

Electronic components are particularly sensitive to extreme relative humidity levels. High atmospheric moisture content, as indicated by high relative humidity, not only exacerbates chemical breakdown, but also impacts the reliable operation of electronic circuits due to corrosion forming on integrated circuits resulting in reduced or broken circuits, short circuits, reduced conductivity of the components, leads, circuit board assemblies/substrates and connectors. At the other extreme, low atmospheric moisture content, as indicated by very low relative humidity, can also impact the reliable operation of electronic circuits due to increased likelihood of unwanted electrical arcing and Electrostatic Discharge (ESD) events caused by static electrical charge buildup. ESD in particular can cause catastrophic failure of integrated circuit (IC) devices during storage or operation.

Therefore, systems and methods have developed to maintain atmospheric conditions at acceptable humidity and temperature levels. For example, U.S. Pat. No. 2,293,316 to Stebbins discloses a method and apparatus for controlling temperatures of the interior of railroad freight cars by directing conditioned air from an external apparatus into the interior of one or more such freight cars. Further, U.S. Pat. No. 2,620,636 to Stanton shows an external air conditioning system for automobiles that directs conditioned air from an external apparatus into the interior of an automobile through its window. U.S. Pat. No. 3,777,506 to Hergatt et al. shows a portable external air conditioner apparatus for use with recreational vehicles and the like, while U.S. Pat. No. 4,835,977 to Haglund et al. shows an external air conditioner for use with parked aircraft. U.S. Pat. No. 4,901,538 to Anthony shows a portable external temperature maintenance system for use with insulated cargo containers. However, the above systems and methods have significant limitations.

It is often efficient to store equipment in groups (such as, for example, a fleet of vehicles) at a single location, or to concentrate such vehicles in clustered groupings. For example, military vehicles are often stored and maintained at a central facility for storage, maintenance and accountability purposes. Equipment and vehicles at such facilities are either stored inside a building or outside in a staging area. Furthermore, it is often imperative to maintain and store certain types of equipment, such as military equipment, in a manner that provides a high state of readiness to support rapid transition from storage to field deployment. Additionally, detailed knowledge and understanding of the current maintenance and availability status for stored equipment is important in assessing the ability of a group of vehicles to meet a particular anticipated demand profile. In the context of military vehicles, this knowledge directly supports force strength assessment and deployment planning activities. Thus, it would be advantageous to provide a remotely monitored and controlled environmental stabilization system that provides not only environmental status information for stored and/or staged vehicles, but also provides other information directly relating to the accurate location and operational status of the stored and/or staged vehicles and equipment.

SUMMARY OF THE INVENTION

Therefore, it is an object of the present invention to provide a system and method that provides for environmental stabilization of the atmospheric conditions experienced by stored and/or staged equipment and certain components thereof.

It is a further object of the present invention to provide a system and method that provides for electronic remote and local automated control and remote monitoring of environmental conditions.

A still further object of the present invention is to provide a system and method that provides remote monitoring and alerting of changes in equipment location, maintenance, availability status as well as an automated exception alert if an environmental stabilization system is not functioning within its design parameters.

A still further object of the present invention is to provide a system and method that stores data compiled from the system in a data warehouse for retrieval to generate automated reports customized to meet both the user's requirements and the requirements of the service technicians to assess and troubleshoot the system.

These as well as other objects of the present invention will be apparent to those of skill in the art upon inspection of this specification and the associated drawings.

BRIEF DESCRIPTION OF THE DRAWINGS

FIG. 16 shows an example web page display of latest environmental status at an environment stabilization facility provided by a preferred embodiment of the present invention;

FIG. 17 shows an example monthly process control chart provided by a preferred embodiment of the present invention;

FIG. 18 shows an example hourly process control chart provided by a preferred embodiment of the present invention; and FIGS. 19 and 20 depict exemplary interactive status reports used for displaying real-time environmental status provided by a preferred embodiment of the present invention.

DETAILED DESCRIPTION OF THE PREFERRED EMBODIMENTS

The present invention comprises a system and method for achieving and maintaining environmental stabilization for a plurality of stored vehicles, aircraft and/or equipment, and for remotely monitoring and controlling the environmental conditions and the related maintenance status associated therewith. Furthermore, data compiled from the system is stored in a data warehouse for retrieval to generate automated reports customized to meet both the customer's requirements and the requirements of the service technicians to assess and troubleshoot the system. The remote monitoring, control and reporting capability can be retrieved either through a phone line and the Internet.

Figure 1:
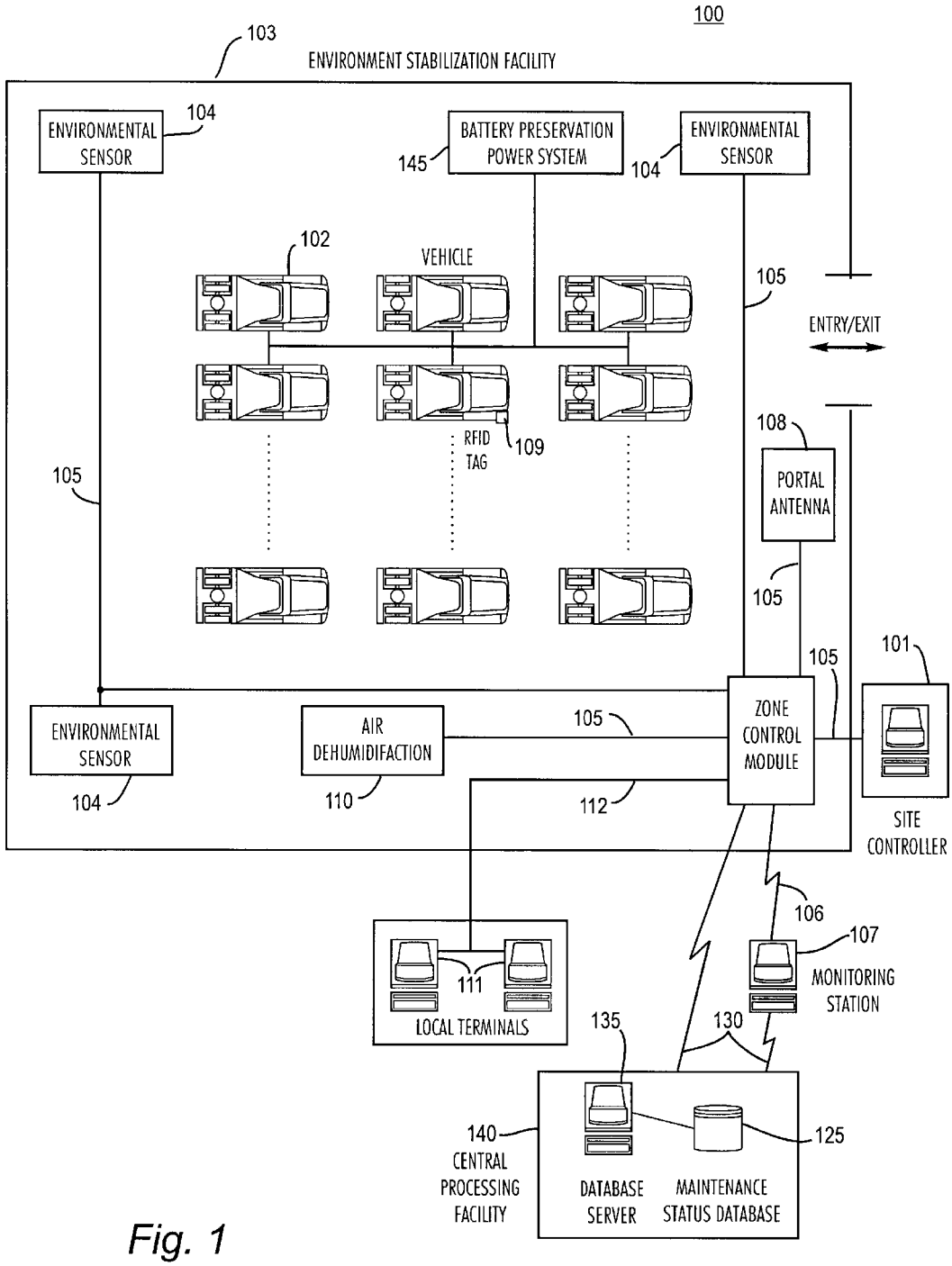
FIG. 1 is a functional block diagram of a preferred embodiment of an environmental support system according to the present invention.

A presently preferred embodiment of an environmental stabilization system 100 in accordance with the present invention is shown in FIG. 1. Referring now to FIG. 1, environmental stabilization system 100 includes: One or more air dehumidification units 110 for use in maintaining the environmental conditions for a plurality of vehicles 102 (including, but not limited to, aircraft or equipment) within an environment stabilization facility 103, environmental sensors 104 electronically communicating with one or more zone control modules 160 or site controller 101, using an local network 105 electronically coupled to a site controller 101 or zone control module 160. Environmental control is achieved and regulated as a distributed control function with an individual controller for each controlled zone, which allows environmental stabilization system 100 zones to operate independently of on another in case of failure. There is no central point of failure in the system of the present invention. The environmental controls can also be locally accessed to provide a Local Human Machine Interface (HMI) to the customer and/or service technicians to allow real-time local monitoring and set-point adjustment.

Referring again to FIG. 1, environmental stabilization system 100 may further include one or more monitoring stations 107 electronically communicating with site controller 101 using an electronic network 106, one or more portal antennas 108 electronically coupled to site controller 101 via a local network 105, one or more local stations 111 electronically coupled to site controller 101 or zone control module 160 via a computer network 112, a maintenance status database 125 via status reporting network 130, and a battery preservation power system 145.

While FIG. 1 shows a preferred embodiment of environmental stabilization system 100 having a site controller 101 and one or more zone control modules 160, it is to be understood that in different embodiments environmental stabilization system 100 may include one or more zone control modules 160 with or without site controller 101 present at a given storage site. For embodiments having one or more zone control modules 160 and site controller 101, each zone control module 160 communicates electronically with site controller 101 using local network 105, and site controller 101 receives all information received by each zone control module 160.

Vehicles 102 include, for example, but not limited to, military vehicles such as trucks, tanks, troop carriers, aircraft or commercial vehicles, equipment or stored assets. Vehicles 102 can include any device or machine used to convey persons or things, including, but not limited to aircraft, cargo containers, equipment and commercially stored equipment. In a preferred embodiment, each vehicle 102 includes a radio frequency identification (RFID) tag 109 mounted to the exterior of vehicle 102. RFID tag 109 includes a unique vehicle identifier that is transmitted to portal antenna 108 upon electronic detection and interrogation of RFID tag 109 by portal antenna 108. RFID 109 is preferably enclosed by a mounting bracket (not shown) specially designed to enclose RFID tag 109, reduce RF signal reflection during electronic communications with portal antenna 108, and protect the electrical and mechanical components of the RFID tag 109. The mounting bracket is affixed to the exterior of vehicle 102 at a location suitable for electronic communication with portal antenna 108 when vehicle 102 enters or exits environment stabilization facility 103 or other controlled access areas such as an outdoor parking facility, warehouse area or port facility with portal antennas at entrance and exit gates.

Preferably, portal antenna 108 is located in close proximity to each location of vehicle ingress into and egress out of facility 103. In a preferred embodiment, portal antenna 108 is capable of indoor or outdoor operation and is encased in a protective material such as, but not limited to, Plexiglas or FR-4. In a most preferred embodiment, portal antenna 108 includes microwave or Passive Infrared (PIR) motion sensors capable of determining and reporting the direction of movement of a vehicle 102 transitioning an entrance/exit of environment stabilization facility 103. Transceiver unit 108 transmits RFID tag 109 identification data to site controller 101 using local network 105. This data may include the date/time (e.g., timestamp) at which the event occurred, the doorway/gateway at which the event occurred, the asset identification, owning unit, and direction of the event, whether into/out of the area monitored. Other such data may also be included. Portal antenna 108 preferably includes a NCB™ Router or other LON gateway communicating in accordance with the LonWorks® communication protocol using local network 105.

Local network 105 is preferably a control network provided in accordance with American National Standards Institute ( ANSI) ANSI/EIA 709.1-A-1160, such as the LonWorks® system available from Echelon Corporation of Sunnyvale, California. Detailed information concerning LonWorks® is available from numerous industry sources and the World Wide Web, such as the web page located at "echelon.com/products/core." ("www" prefix.) The NCB™ router gateway acts as a network services interface (NSI) in conjunction with local network 105, and functions generally as a router. Alternatively, local network 105 may comprise any wired or wireless communications network suitable for computer-aided control applications such as, but not limited to, either an EIA-232 twisted pair serial interface, single twisted pair, using LONTALK protocol for communications.

Environmental sensors 104 measure relative humidity level, air temperature, dew point, door conditions and combustible fumes values and provide these measurements to site controller 101 or zone control module 160 via local network 105. Environmental sensors 104 includes a transducer and control hardware to convert the analog values of combustible fumes, dewpoint, temperature and humidity measurements and discrete digital input and output values to digital format and a transceiver suitable for encoding transmissions using local network 105.

Air dehumidification unit 110 produces dehumidified air. Air may be dehumidified and chilled, but not all embodiments of environmental stabilization system 100 require both temperature and humidity control. Embodiments of environmental stabilization system 100 requiring both temperature and humidity control of the storage environment utilize separate chiller units, air conditioners and heaters to control temperature. All chiller units, air conditioners and heaters share the same air distribution system to route conditioned air throughout the environment stabilization facility 103. Utilizing additional heating and air conditioning systems integrated into and controlled by environmental stabilization on system 100, the temperature of the environment can also be controlled.

One or more air dehumidification units 110 may be included within an environment stabilization facility 103. Air dehumidification unit 110 is electronically coupled with Zone Control Module 160 to schedule the ON/OFF state of air dehumidification unit 110. In a preferred embodiment, air dehumidification unit 110 does not require or include the capability to add humidified air in order to maintain the relative humidity level above 30% relative humidity, within 5% standard deviation therefrom. Air dehumidification unit 110 ranges in output capacity from 50 standard cubic feet per minute (SCFM) and up to and exceeding 9000 SCFM. SCFM measures the cubic feet of dehumidified air that an air dehumidification unit 110 can produce in one minute. In a preferred embodiment, air dehumidification units 110 are capable of operation in an operational temperature range of −40° C. to +95° F. Air dehumidification units 110 also may include the ability to return to operation without human interaction following the interruption of electrical power to the unit. Air dehumidification unit 110 may also include strip heaters in the housing to ensure operation at low temperatures as well as air filters to limit dirt and dust ingestion. Air dehumidification unit 110 is monitored in its operation for its on/off status, process out temperature and relative humidity, reactivation temperature and relative humidity, cumulative run time hours and these values are transmitted across network 105 to the site controller 101 and/or zone control module (160).

Environment stabilization facility 103 may be any structure in which one or more vehicles 102 is housed and capable of substantially containing conditioned air for the stored items or vehicles 102. Examples of environment stabilization facility 103 include, but are not limited to, a garage, service bay, warehouse or hangar. However, environment stabilization facility 103 is preferably a relocatable shelter constructed from metal or tension fabric.

Furthermore, environmental stabilization system 100 is capable of being deployed in an outdoor environment for the control of vehicles 102 which is maintained in an operational status as opposed to a stored status. Such Operational Preservation (OP) embodiments for environmental stabilization system 100 do not require environment stabilization facility 103 because the cavity of the interior region of an item or vehicle 102 is utilized to contain conditioned air in order to create a controlled environment within the interior spaces of the vehicle 102 (including aircraft, container or equipment). For example, vehicles 102 in a parking area can be collocated near an air dehumidification unit 110 and conditioned air routed into the interior compartments via specially configured and proprietary adapters. Conditioned interior compartments are then remotely monitored and controlled utilizing the same methods and technologies described herein. Such OP embodiments of environmental stabilization system 100 may or may not include portal antenna 108.

A storage site is a location at which equipment or one or more vehicles 102 are stored. A storage site may contain one or more environment stabilization facilities 103 for this purpose. In a preferred embodiment, a single site controller 101 is used at a storage site, regardless of the number of environment stabilization facilities 103 provided at that storage site.

Local stations 111 communicate with site controller 101 and/or zone control module 160 using computer network 112 or LonTalk Network, which is preferably a Transmission Control Protocol/Internet Protocol (TCP/IP) based Ethernet Local Area Network (LAN). Local station 111 is preferably a personal computer (PC) running a web browser application such as, but not limited to, Microsoft® Internet Explorer™, and an electronic mail application such as, but not limited to, Microsoft® Outlook™. However, local station 111 may be any web browser or electronic mail enabled electronic appliance, such as, but not limited to, a personal organizer. Each local station 111 and site controller 101 includes a LAN card and communications driver software to enable communication via computer network 112. One or more local stations 111 may be collocated at environment stabilization facility 103 or, alternatively, elsewhere at the storage site. Local station 111 also includes, preferably, Microsoft® Windows™ NT workstation software version 4.0, and an Internet browser such as Microsoft® Internet Explorer version 5.0 or Netscape version 4.6.

Monitoring station 107 communicates with site controller 101 using electronic network 106. In a preferred embodiment, monitoring station 107 is located remotely from environment stabilization facility 103 and vehicles 102. Alternatively, monitoring station 107 may be collocated with environment stabilization facility 103 and/or vehicles 102. Monitoring station 107 includes a personal computing device 120 and includes standard peripherals including a modem providing dial-up access to the Internet and direct remote access to site controller 101 using, for example, PCAnywhere communications software or Remote Access Server (RAS).

Site controller 101 includes a personal computer server (preferably Pentium II based), an interface card and software for communicating with local stations 111 via computer network 112, and a PC to LonTalk™ Adapter (PCLTA-10 card) for communicating with air dehumidification unit 110, portal antenna 108, battery preservation power system 145 and environmental sensor 104. Site controller 101 also includes, preferably, Microsoft® Windows NT version 4.0 (Server SP6), Microsoft® Structured Query Language (SQL) Server 7, Microsoft® Internet Information Server (IIS™) application, PCAnywhere communications software for remote dial in communications, and Microsoft® Online Database Connectivity (ODBC) drivers. Detailed information concerning use of JIS™ for web applications may be found in industry publications such as the development guidelines provided online at "hftp://www.microsoft.com/NTServer/web/deployment/planguide /WebAppDev.asp" published by Microsoft® Corporation.

Zone control module 160 generally includes the same hardware and software components as described for site controller 101, with the exception of the RFID asset tracking capability and the software application programs used to provide the graphical user interface capabilities for local control and monitoring as described later herein. Zone control module 160 preferably includes a removable hard disk drive (i.e., a hard disk drive with removable media) and a floppy disk drive for non-volatile storage of environmental sensor 104 information as well as other maintenance status information as described herein.

Using the capabilities provided by a preferred embodiment of environmental stabilization system 100 as described above, environmental stabilization system 100 provides Internet worldwide web based control of environmental conditions for vehicles 102 located at a storage site. Environmental stabilization system 100 further provides Internet worldwide web based monitoring of environmental as well as maintenance status conditions of vehicles 102. Access to the devices attached to local network 105 is provided via SLTA device paired with a modem to allow remote dial-up or continuous connection access. Furthermore, access to environmental stabilization system 100 for remote monitoring and control may be had via Internet connection to monitor the conditions of environmental stabilization system 100, check on maintenance status of supported vehicles 102 and/or equipment, set control parameters, and allow the user or customer interface to check on the performance of the system 100. Local stations 111 and remote station 107 include a software application programs that communicate with central processing facility 140 to allow off-site service technicians to connect to environmental stabilization system 100 to allow real-time visibility of the components of the system 100 for purposes of servicing and troubleshooting. Out of parameter conditions generate exception reporting via e-mail to service technicians to notify of a system performance fault.

Site controller 101 provides real-time automated control and monitoring of environmental stabilization system 100, as described herein, for example, in order to reduce or eliminate the need for on-site manual monitoring of environment control and related systems. (In certain applications, zone control module 160 is utilized in place of site controller 101 if the user or customer determines that it has no requirement for RF tracking of its assets.) To accomplish this real-time automated control and monitoring, software control application programs are provided at a central processing facility 140 whose functions include retrieving the data files that are stored in zone control modules 160 non-volatile storage.

The software control application programs provided at central processing facility 140 that allow interaction with environmental stabilization system 100 devices will now be described. Functions provided by the software control application programs include, but are not limited to, real-time monitoring, set point adjustment, historical data retrieval, alarm monitoring and clearing, and manual override of system 100 operation. These interactions can be accomplished either locally using local terminals 111 or remotely using monitoring station 107, as described herein. In addition, remote access may be provided via a variety of communications means including switched and wireless analog telephone connections, and wireless or dedicated wired internet access, as well as for satellite communications and wireless AM or FM two-way transmission.

The software control application programs include security and user modes to allow for certain functions to be restricted or granted as needed. User modes enable the programs to interact with environmental stabilization system 100 either manually or automatically.

The devices and points of access within environmental stabilization system 100 provided by the software control application programs are user selectable so as to permit interaction with local (same computer) or remote (networked computer) or a hybrid combination (Local and Remote) databases based on user preferences and needs. In a preferred embodiment, the software control application programs use industry standard ODBC connections to allow the database host (i.e., database server 135) to run any number of commercially available ODBC compliant applications such as Microsoft Access™, Microsoft SQL Server, as well as Oracle® and IBM D-Base database systems.

Add-ons or plug-ins are available for the software control application programs that allow for advanced functions such as trending analysis of historical performance data, calculators for temperature conversions, and advanced alarm management and notification allowing for e-mail and pager notification of events (including, for example, wireless delivery of e-mail notifications to a personal digital assistant (PDA) of a field service technician). Also provided are audit trails of user activity, call log information including details of type of call, length, bytes sentireceived and any communications related errors that may have been encountered during the call.

The software control application programs further include system 100 maintenance utilities to allow for local and remote diagnostics and maintain of environmental stabilization system 100. Capabilities of the utilities include, but are not limited to, remote modem programming, clock adjustment, set point adjustment, logging intervals, and a built in free-form terminal program that allows the user to perform dozens of command line operations.

Environmental and status data obtained from zone control module 160 are stored and made available to a management reporting system (MRS) database server, also located at central processing facility 140. MRS performs the required data storage, reduction, and notification and reporting as described herein.

In a preferred embodiment, MRS is a decision support system (DSS) that interfaces with software control application programs to collect historical data from many environmental stabilization systems 100 deployed worldwide using either dial-up switched telephone, wireless analog cellular or internet communications. MRS processes this aggregated environmental stabilization system 100 data by applying advanced calculation and data reductions and produces alerts or reports based on user defined conditions. The MRS also acts as a data warehouse for millions of environmental data points, call log information, exception (alerts and alarms) clearinghouse for various reporting systems, and ad-hoc query tools.

The MRS provides for automated monitoring of all activated sites on a round the clock, year-round basis. Little or no user interaction is required to maintain MRS monitoring functions. In a preferred embodiment, the MRS architecture allows for Check-In servers running the software control application programs in an "Auto User" mode with the proper security rights to contact a storage site (site controller 101 or zone control module 160), retrieve data, and reset data registers, as well as to retrieve detailed machine operation information and site alarm conditions. The Check-In servers are provided with redundancy and failover safe capabilities, and also with load-balancing of monitoring load across all operational servers. If any server fails the remaining servers will continue to service all sites. The MRS Check-In server system is designed to auto-restart and resume monitoring after power failures and to reboot and restart on fatal operating system errors. Servers may be added or removed as the site load dictates without effecting the entire operation as a whole.

The MRS disseminates information in the form of alerts and reports. MRS constantly analyzes incoming data for anomalies, out of service and out of parameter violations, non-communication with environmental stabilization system 100 sites, or environmental stabilization system 100 hardware devices extended call lengths or communication errors, and other alarm or alert conditions. MRS uses this information to raise alerts which may be transmitted to service personnel in the manner described herein.

MRS also monitors the aggregate environmental stabilization system(s) 100 data to track system performance over a day period, by averaging control and ambient parameters into daily numbers. These calculated values are then compared against user defined setpoints and alerts are raised accordingly. MRS also provides trend analysis to allow for predicting and recommending preventive maintenance activities to be accomplished prior to equipment breakdown occurring. MRS also provides for alarm filtering thresholds to reduce false alarm events. These analyses may be provided on a machine, model, or location basis.

MRS alerts are logged into maintenance status database 125 and electronic notification is sent to the responsible person(s) to decide if further action is required. The notification system uses Simple Network Mail Protocol (SNMP) to allow any Internet mail account to be used as an alert recipient. MRS is also enabled to use Microsoft Exchange to allow alerts and reports to be distributed to groups in a single step. Alerts are categorized as to whether a response or explanation is required by the system for the anomaly. If no action is required the alert is closed and no further action is required. If however the alert does require a response, the responsible party must respond within a specified period before the alert is raised to the next level for action. This escalation allows for supervisory personnel to react to inaction or oversight before a significant period expires. There are five response avenues available to deal with alert management and the posting of outage or service codes for a given alert.

Personnel—Replies with a simple statement to the original e-mail. MRS parses the response and places the text into the Alert record.

Personnel—Uses a secured web-site to enter more complex data on the alert.

Personnel—Calls and operator enters information.

Personnel—Uses MRS front end to respond to individual alerts.

MRS—In some cases the MRS system will determine the cause or due to the age of the alert automatically respond to the alert.

The MRS reporting system uses stored procedures to report non-alert related data at scheduled intervals. In a preferred embodiment, these stored procedures are provided in the form of SQL scripts and stored using maintenance status database 125. A number of reports are summaries of alert data for a given period for supervisory review. There are a number of system related reports that report on overall database health. The primary purpose of the MRS reporting system is, however, environmental stabilization system 100 operating performance. These performance reports are either generated ad-hoc in response to a request received via interactive web site, or as part of a monthly reporting cycle. These reports use the maintenance status information collected and calculated during the period in question to generate charts based on the control and ambient parameters. If a pertinent alert has been raised by MRS during the period it to will be displayed, along with any response in the report.

Examples of other MRS reports include:

Daily/Weekly/Monthly/Annual Call Detail Reports

Open Alert Reports by Client/State/Site/Type/ Responsible Party

Alerts by Type/Site/Responsible Party

Machine Performance Reports

Communications Problems Reports

Data Discrepancy by System (Missing or Invalid Data)

Active/inactive Site Listings

Telephone Lists

Audit Trail Change Reports

Further, MRS includes data mining tools to extract and report information, according to different views or perspectives, from maintenance status database 125 for complex and one-time queries. For example, MRS provides user or service personnel the capability to observe how a particular component of environmental stabilization system 100 is performing across multiple sites, to monitor the maintenance history of a particular component of environmental stabilization system 100 to predict upcoming failure before it occurs, and to track the failure rates of the various communication links components of or used by environmental stabilization system 100. Communication link tracking includes the capability to determine aggregate packet loss over time (by comparing the number of packets of known size expected to have been received at a given location or component to the actual number of packets successfully received over a discrete period of time) and Internet web page access time.

The MRS is maintained either directly at the SQL database server 135 or through tools that allow remote access to the database and information. MRS includes tools useful to maintain and update the MRS system and information, including administrator tools and user tools. Administrator tools can be used to modify database structures and data, where user tools can only interact with data. MRS tools include a SQL administrator and an MRS front end. The MRS SQL Administrator tool allows complete control of maintenance status database 125 either locally from SQL database server 135 or from a remote client. In a preferred embodiment, the MRS Front End Administrator/User tool is implemented using Microsoft Access and can be used in either Administrator or User mode depending on login and needs criteria. Large scale changes to data can be made, and moderate design changes to the overall database can be made in Administrator mode. In User mode and individual may add, delete or edit data in many of the tables for the creation or maintenance of site related information, they may also generate reports and run ad-hoc queries. There is also provision for maintenance and processing of Alerts.

Further MRS tools include an Information Update user tool, by which users can request the software control application programs to update certain site related information items, and a Web Site Access user tool that allows for complete user interaction with the MRS database. Sites can be maintained, alerts can be processed individually or in batches, site performance data can be reviewed, system reporting status for all systems 100 can be set, user account and security rights can be assigned, audit logs can be reviewed, in addition to other functions. This is accomplished primarily through use of an extranet arrangement by which user or service personnel can access vehicle maintenance status, including environmental status, maintained at central processing facility 140 from monitoring station 107 using a HyperText Transfer Protocol (HTTP) enabled Internet connection via reporting network 130. FIG. 16 shows a web page accessible to user or service personnel using monitoring station 107 provided by a preferred embodiment of the present invention.

Thus, environmental stabilization system 100 provides user and service personnel visibility into both real-time actual equipment performance and status, and current site environmental and maintenance status conditions, via the software control application programs, combined with MRS tools for analyzing historical environmental and maintenance data statistically and from a variety of perspectives. This combination allows environmental stabilization system 100 to provide user and service personnel the capability to maintain vehicles 102, as well as to effectively service and control environmental stabilization system 100 equipment, with less manpower and increased responsiveness, thereby effecting increased vehicle 102 availability for mission readiness or use at reduced cost. For example, advanced alerting and back office data analysis are two capabilities provided by environmental stabilization system 100 to achieve this result.

In order to provide information required by the software control application programs and MRS, site controller 101 and or zone control module 160 collects data from air dehumidification unit 110, portal antenna 108, battery preservation power system 145, and environmental sensor 104 in a daily activity log. The daily activity log is periodically transmitted to database server 135 for permanent storage in maintenance status database 125, preferably two to four times a day. Alternatively, the data history log may be downloaded from site controller 101 or zone control module 160 (onto portable non-volatile storage media such as floppy disk). Site controller 101 and data control module 160 has a data log capacity of several weeks; actual storage time varies, based on the number of inputs and the frequency of their sampling. Devices and components of environmental stabilization system 100 are preferably interrogated for current status according to a programmed sequence controlled by software running on site controller 101 or zone control module(s) 160. Using the extranet arrangement described above, user or service personnel can change the sequence and frequency of environmental stabilization system 100 device/component interrogation.

Site controller 101 and/or zone control module 160 can also transmit device and vehicle status information to a database server 135 at central processing facility 140 using reporting network 130. For example, if site controller 101 or zone control module 160 detects an out-of-range condition measured by environmental sensor 104, site controller 101 may generate an alarm condition and turn on the nearest air dehumidification unit 110.

At central processing facility 140, a database server 135 converts the received device and vehicle status information, including vehicle maintenance status, into SQL format and stores the converted information in maintenance status database 125. Database server 135 also formulates SQL queries to obtain requested status information and formats the information received from maintenance status database 125 into a hypertext Markup Language (HTML) formatted file which is transmitted for display at site controller 101. A local server is the processing point where the maintenance status, inventory levels, and daily activities are processed, and displayed in the form of a graphical user interface (GUI). The data can be transmitted to other sites, over the network, by using the dial up connection or Internet access other transmission media. Furthermore, site controller 101 also transmits the HTML formatted status information to local stations 111 via computer network 112 and to monitoring station 107 via electronic network 106.

Figure 20:
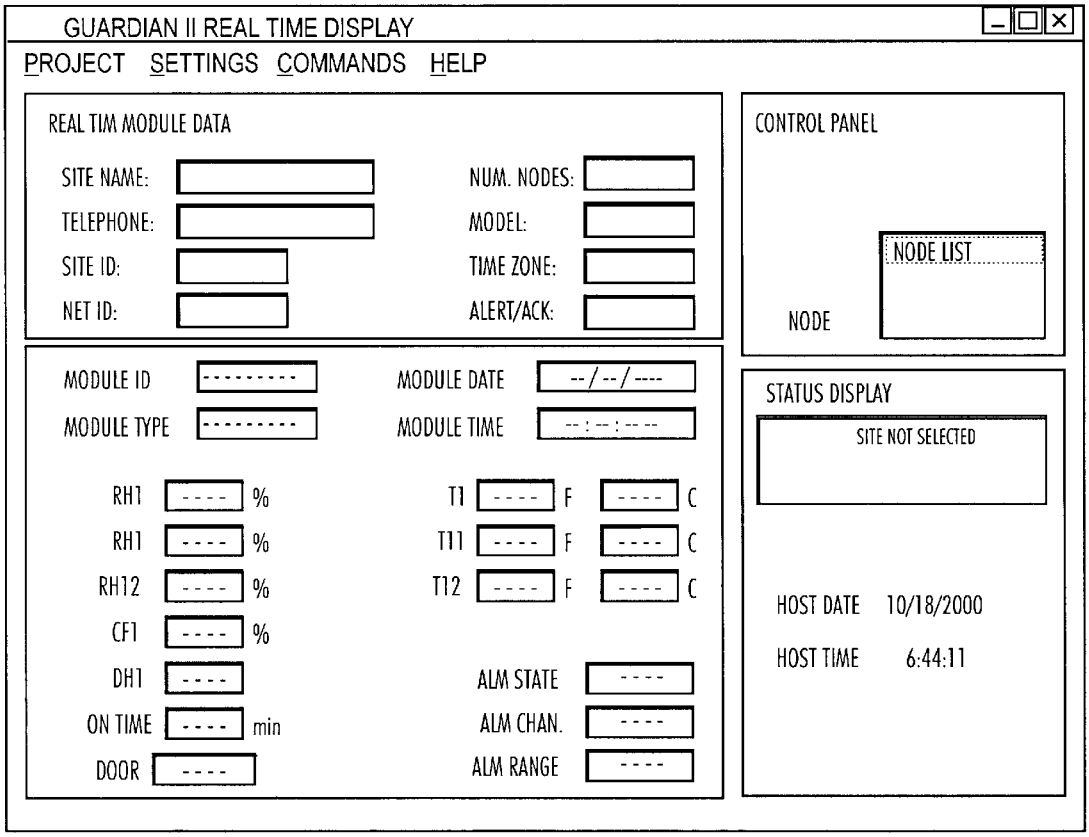

Central processing facility 140 further constitutes a data warehouse to facilitate system performance reporting through use of interactive status reports 300, exception log reports 200, site controller 101 daily activity log, and compliance report 305 produced by database server 135 using information stored in maintenance status database 125. Database server 135 periodically requests site controller 101 to transmit the daily activity log to database server 135 for permanent storage in maintenance status database 125. This is preferably accomplished on a four-times-per-day basis. At this time database server 135 also obtains from site controller 101 a snapshot of the real-time conditions and status at the storage site. Both the historical daily activity log data and the current status data are checked by database server 135 for compliance with respect to operational requirements and then stored in maintenance status database 125. Both the historical daily activity log data and the current status data are also available to users via monitoring station 107 and local stations 111 in the manner described herein. FIGS. 19 and 20 depict exemplary interactive status reports 300 for displaying real-time environmental status, as provided by a preferred embodiment of the present invention.

In a preferred embodiment, electronic network 106 comprises an Internetbased interface accessed using the public switched telephone network. However, electronic network 106 may alternatively be implemented via dedicated telephone line, wireless communications network, including wireless Internet or IP-based network, or other type of telecommunications link. Environmental stabilization system 100 is preferably implemented as a client-server architecture as shown in FIG. 1 in which site controller 101 and/or zone control module 160 is the server and monitoring station 107 and local stations 111 are clients. Site controller 101, monitoring station 107, and local stations 111 are capable of transmitting and receiving electronic messages over electronic network 106 in accordance with the Simple Mail Transport Protocol (SMTP). Site controller 101 is capable of serving worldwide web pages over electronic network 106 in accordance with the Hypertext Transport Protocol (HTTP), and monitoring station 107 and local stations 111 are capable of receiving web pages over electronic network 106 from site controller 101 and displaying the web pages using a web browser. Client users interact with environmental stabilization system 100 using web browser enabled and electronic mail enabled monitoring station 107 and local stations 111 to request status information, transmit commands, and receive alert messages.

Battery preservation power system 145 ensures that the battery for each vehicle 102 is maintained in a state of readiness and serviceability. In a preferred embodiment, battery preservation power system 145 supplies electrical power to multiple solar-powered, pulse-type battery condition maintenance devices such as the Solargizer™ product available from PulseTech® Products Corporation of Southlake, Tex. and as described in U.S Pat. No. 5,063,341, the entire disclosure of which is hereby incorporated by reference into this specification as if set forth fully herein. Battery preservation power system 145 is useful for supplying electrical power for battery preservation when vehicle 102 is located within environment stabilization facility 103 wherein little sunlight is available for providing solar power to each pulse-type battery maintenance device.

In a preferred embodiment, battery preservation power system 145 converts 110 VAC power to DC power, and delivers between 6 VDC and 9 VDC at 15 to 18 amps system power at 300 milliamps for each 24-volt, pulse-type battery charge maintenance device using flame-resistant and abrasion-resistant copper wire cables. The cables attach to pulse-type battery maintenance devices via a line plug using simple mechanical interlock connectors to permit quick release. Battery preservation power system 145 provides fault status information to site controller 101 for fault reporting to facilitate rapid fault isolation.

In operation, site controller 101 or zone control module 160 receives environmental status information from environmental sensors 104 indicating relative humidity and temperature measurements taken at one or more locations throughout the environment stabilization facility 103. Site controller 101 or zone control module 160 responds to this received environmental status information by transmitting digital commands to air dehumidification unit 110 to cause air dehumidification unit 110 to operate and to operate any peripheral chillers, air conditioners and heaters. Site controller 101 or zone control module 160 transmits commands to air dehumidification unit 110 and peripheral heating and cooling unites as required in order to maintain the temperature and relative humidity present throughout the interior of environment stabilization facility 103 within a preferred range for these parameters. In a preferred embodiment, site controller 101 or zone control module 160 maintains atmospheric temperature and relative humidity between 30% and 40% or as determined by the system design throughout the interior of the environment stabilization facility 103. In this way, environmental stabilization is achieved and maintained for the vehicles 102 or equipment stored within the environment stabilization facility 103. Preferably, site controller 101 or zone control module 160 maintains atmospheric temperature and relative humidity throughout the interior of the environment stabilization facility 103 between 30% and 40% relative humidity 90% of the time, and between 30% and 50% relative humidity 100% of the time, or as determined in the system design.

Site controller 101 provides a graphical user interface by which a user of environmental stabilization system 100 can adjust the preferred range by interacting with site controller 101 directly using the site controller 101 mouse and keyboard, or by transmitting via computer network 112 similarly-entered changes at local station 111, or by transmitting via electronic network 106 similarly-entered changes at monitoring station 107.

Site controller 101 provides alerting functions to users of environmental stabilization system 100 in response to certain conditions or events via the interface with data warehousing servers 135. For example, if environmental status information provided by environmental sensor 104 indicates a measured out of range condition, site controller 101 determines an out-of-range condition and in response generates an out-of-spec condition message. Site controller 101 transmits the out-of-spec condition message to the software control application programs at central processing facility 140. As described earlier, the software control application programs provide an indication of the out-of-spec condition to the MRS, which may generate an alert notification, if so instructed, to inform service personnel of the out-of-range condition so that corrective action may be taken.

Site controller 101 also maintains maintenance status for each vehicle 102 associated with the environment stabilization facility 103. In a preferred embodiment, maintenance status for each vehicle 102 includes, but is not limited to, an indication of whether vehicle 102 is checked-out of environment stabilization facility 103 (e.g., in/out), scheduled maintenance events, time in service, time out of facility or staging area, engine hours, mileage, and service history.

Portal antenna 108 reads and interrogates the RFID tag 109 for vehicle 102 each time a vehicle 102 enters or exits environment stabilization facility 103 or staging area. Upon detecting entry or exit of a vehicle 102, portal antenna 108 transmits a Vehicle Movement indication, including the unique RFID tag number 109 for the associated vehicle 102, to site controller 101. Upon receipt of a Vehicle Movement indication, site controller 101 updates the maintenance status for that vehicle 102 stored in the maintenance status database 125 and generates a Vehicle Movement alert message. Site controller 101 transmits the Vehicle Movement alert message to local stations 111 via computer network 112 and to monitoring station 107 via electronic network 106. Upon receipt of the Vehicle Movement alert message, local stations 111 and monitoring station 107 generate an audible and visual alert notification to inform user personnel of the change in status of vehicle 102.

Site controller 101 also calculates and tracks the time that a vehicle 102 is outside of environment stabilization facility 103 (i.e., the elapsed time from vehicle 102 exit until vehicle 102 reentry, Time-out-of-Shelter (TOS)) based on the time of exit from and reentry into environment stabilization facility 103 as detected by portal antenna 108. The Time Out of Shelter (TOS) is calculated and the maintenance database updated. Site controller 101 retrieves vehicle 102 service interval table information from the maintenance database and determines if any services are due for that vehicle based on the TOS. If services based on the TOS are due, then the vehicle 102 or asset is flagged as "Service Due."

While a vehicle 102 is located within environment stabilization facility 103 under environmental stabilization, vehicle 102 does not accrue additional service time toward its next scheduled maintenance or service milestones; that is, the vehicle 102 maintenance clock is stopped while it is maintained under environmental stabilization using environmental stabilization system 100. Site controller 101 stores the accrued service time for each vehicle 102 in maintenance status database 125 and adjusts vehicle 102 accrued service time by the Time-out-of-Shelter (TOS). The accrued service time and TOS is available to a user upon request in the form of one or more reports provided to local stations 111 or monitoring station 107 in the manner indicated herein. In this way, environmental stabilization system 100 provides accurate time-to-maintenance/service status information for vehicles 102 associated with environment stabilization facility 103.

Figure 2:
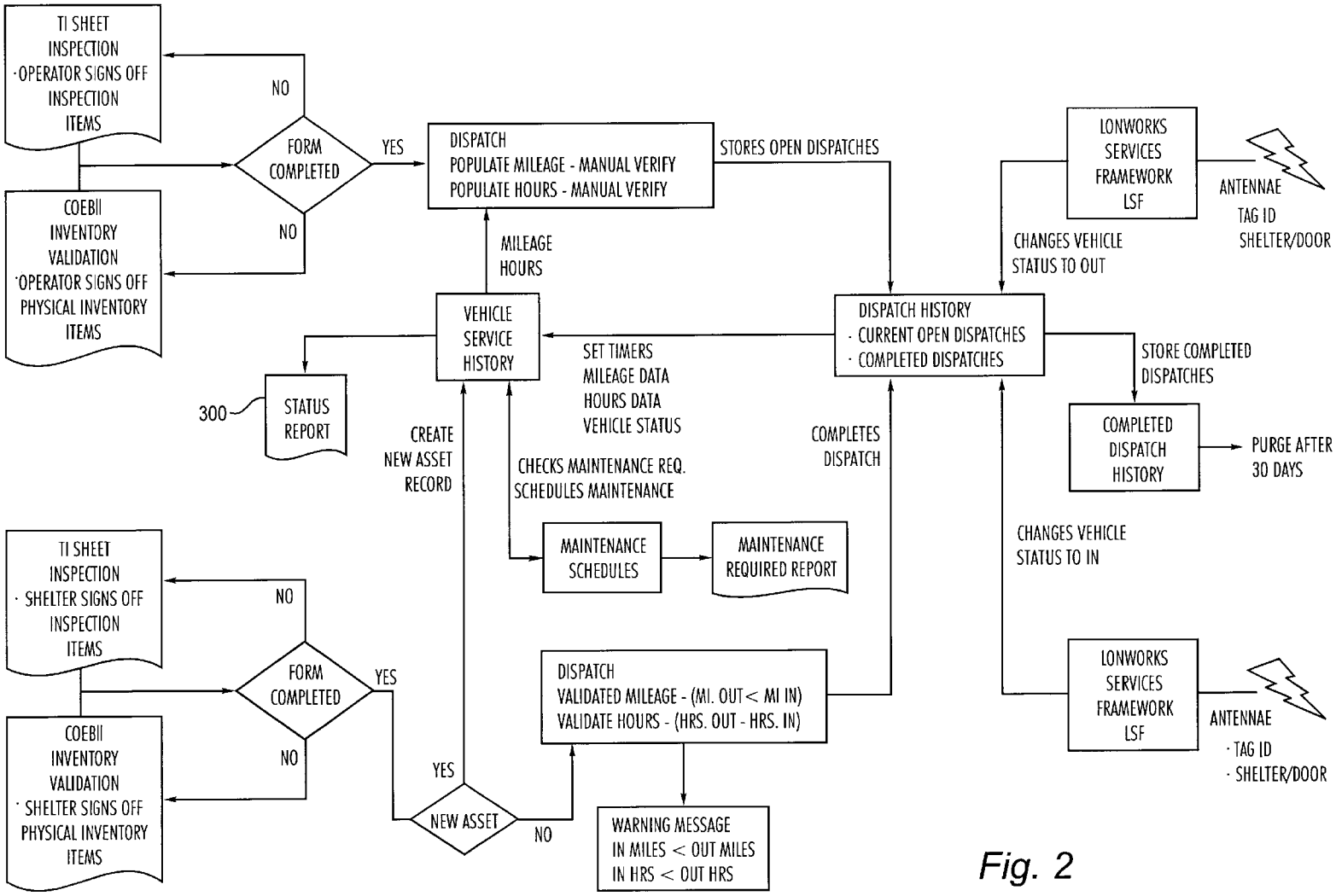
FIG. 2 is a process flow diagram of the exceptions checking functions provided by a site controller in accordance with the present invention.

These and other functions, preferably implemented in application software, are provided by site controller 101 as generally shown in FIG. 2. FIG. 2 is a process flow diagram of the exceptions checking functions provided by site controller 101. Referring now to FIG. 2, site controller 101 monitors changing vehicle 102 maintenance status for exceptional conditions such as, for example, but not limited to, completion of required inspection and inventory validation forms as well as proper vehicle 102 mileage and usage hours log entries.

MRS provides provides several interactive status reports 300 (using database server 135 and maintenance status database 125) useful to a user of environmental stabilization system 100 to obtain vehicle 102 status and maintenance information stored in maintenance status database 125. In a preferred embodiment, MRS interactive status reports 300 are provided in accordance with the Active Server Pages standard for serving World Wide Web pages. Active Server Pages (ASP) refers to a standard used in generating interactive web pages that utilizes ActiveX scripting implemented, preferably, using Microsoft® Virtual Basic Script or JavaScript code instructions. An interactive web page refers to a web page in which the user client can enter or modify the displayed information and transmit the modifications to the server for updating the associated stored values.

To receive interactive status report 300 using environmental stabilization system 100, in a preferred embodiment, a user at remote monitoring station 107 enters the Uniform Resource Locator (URL) associated with the Internet address of MRS at database server 135 into the web browser of the monitoring station 107. Monitoring station 107 then transmits an HTTP-formatted message to database server 135 requesting the web page designated in the URL. Database server 135 then establishes an Internet session with monitoring station 107 (i.e., session-layer connectivity is established between database server 135 and monitoring station 107, independent of the underlying transport, data link, and physical layer protocols). Upon receipt of this web page request message, database server 135 executes the appropriate ASP script to generate the requested interactive web page from the information contained in maintenance status database 125. The web page thus generated is then transmitted by database server 135 to monitoring station 107 in accordance with the HTTP messaging protocol. Upon receipt, monitoring station 107 displays the interactive web page containing the associated status report 300 via web browser.

Figure 3:
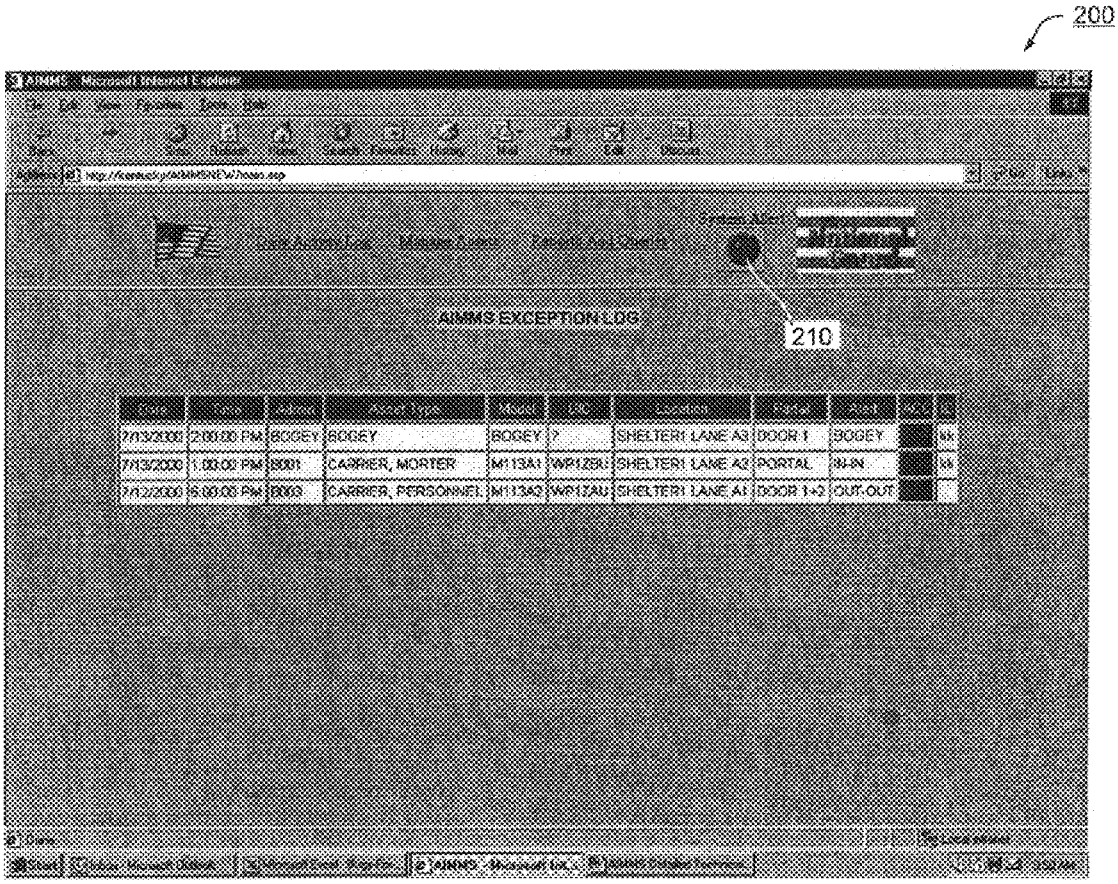
FIG. 3 is an example of a preferred exception log report according to the present invention.

One such MRS interactive status report 300 provided by database server 135 is an exception log report 200 that serves to document certain events. FIG. 3 is an example of a preferred exception log report 200 provided by @ database server 135. Exception log report 200, as well as each status report 300 generally, includes an interactive System Alert indicator 210 as shown, for example, in FIG. 3. System Alert indicator 210 is used to indicate to a user of environmental stabilization system 100 that a change in maintenance status or environmental status has occurred. In a presently preferred embodiment, when activated, System Alert indicator 210 is shown in red and blinking on status report 300 and is accompanied by an audible alert such as a beeping sound. The user can acknowledge the System Alert indicator 210 by selecting it using a mouse device. Acknowledgment will silence the audible notification and cause the visual System Alert indicator 210 to stop flashing and change color to green, and will also cause exception log report 200 to be displayed.

For example, referring back to FIG. 2, site controller 101 will check the returning mileage and hours entered into the system from a dispatch form. Specifically, site controller 1001 will check for inbound mileage and hours being less than the outbound mileage and hours; if so, site controller 101 will provide an exception condition message to the software control application programs at central processing facility 140, which in turn will trigger MRS to generate an alert message provided to the user or service technicians as described herein. The alert message will cause local station 111 and monitoring station 107 to activate System Alert indicator 210, resulting in a visual and audible alert notification to the user.

Further, a vehicle 102 returning without a dispatch form existing from its departure will generate an exception event in the exception log of site controller 101. In this situation, however, an alert is not triggered because it is not unusual for a vehicle 102 to be moved between environment stabilization facility 103 and other maintenance areas, a situation for which no dispatch form is normally issued.

Additionally, entry of a dispatch form contents at site controller 101 triggers site controller 101 to perform a check of services due based upon cumulative hours out of shelter (TOS) previously logged in the maintenance database, against the services that would be due as part of TOS scheduled services.

Other events that generate a System Alert indicator 210 include, but are not limited to, a vehicle 102 entering environment stabilization facility 103 that is already logged "in" by site controller 101, a vehicle 102 exiting environment stabilization facility 103 that is already logged "out" by site controller 101, a loss of communications with a component of environmental stabilization system 100 (communications capability to each node is verified at a periodic interval of, preferably, every five minutes), a vehicle 102 entering environment stabilization facility 103 that is not contained in the site controller 101 maintenance database, and, if an entering or exiting vehicle 102 has services due (site controller 101 checks for services due upon entry and exit).

A user enters an indication of a maintenance event performed in order to reset the TOS clock to zero based on the date performed. (TOS maintenance may be performed in the field prior to returning to environment stabilization facility 103). The TOS clock continues to run until the vehicle arrives back in the shelter.

If services based on MILEAGE or ENGINE HOURS are included in the maintenance interval table, site controller 101 checks the Mileage and Engine Hours against the maintenance interval table and updates maintenance status database 125 when the manual dispatch form is completed and entered. As with the TOS, maintenance performed in the field resets the counters.

Additionally, when site controller 101 detects an RFID tag 109 incoming into environment stabilization facility 103 that is not currently contained in the maintenance database, an alert message will be generated. The system will create new record in the exception log, with Portal, Time/Date, Tag Number, environment stabilization facility 103, and Status (In/Out) with the reason displayed in the log as "BOGEY" as shown in FIG. 3. The system will also create a record in the Daily Activity Log; with tag ID, and Status (In/Out). The Daily Activity Log is periodically transmitted to database server 135 for storage in maintenance status database 135.

Figure 4:
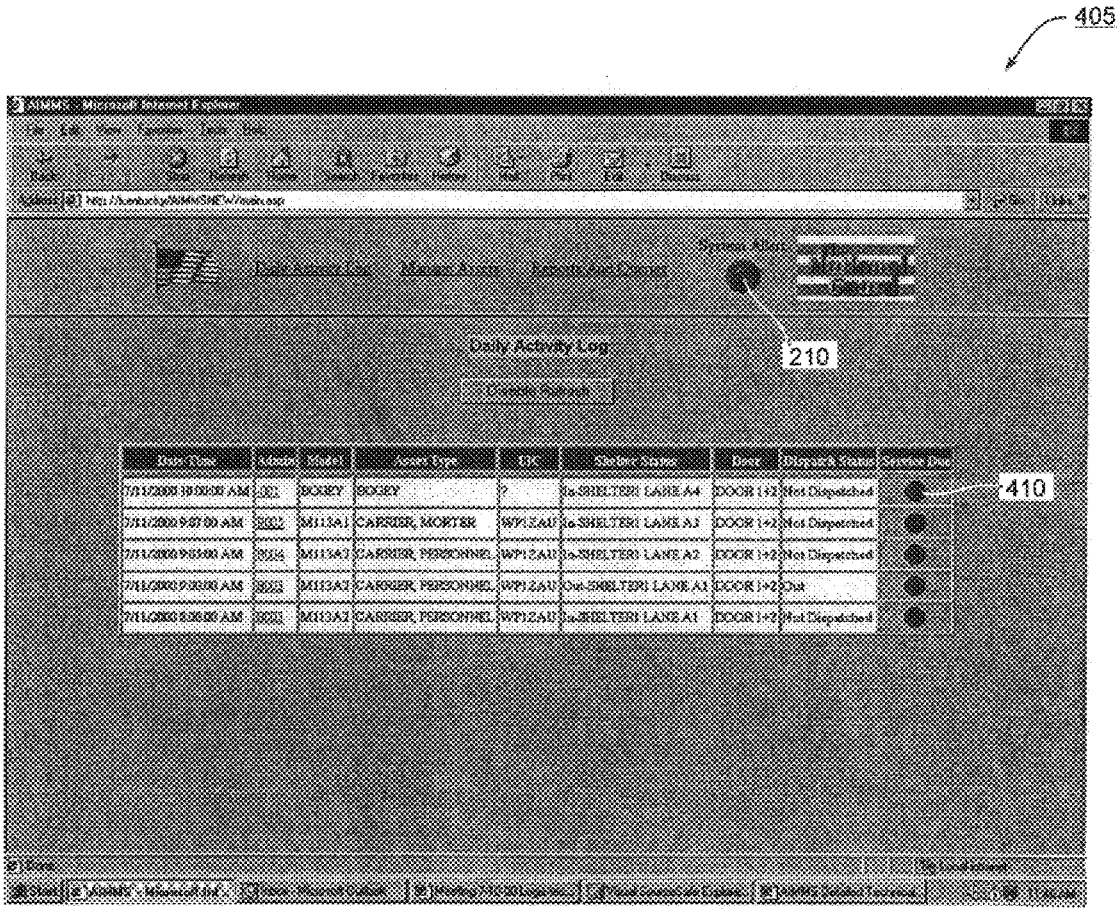
FIG. 4 is a preferred embodiment of a daily activity log in accordance with the present invention.

FIG. 4 portrays a preferred embodiment of a daily activity log 405 in accordance with the present invention. Referring now to FIG. 4, if vehicle 102 requires servicing, a "Services Due" indicator 410 is set and the user notified via a Daily Activity Log 405. Services Due indicator 410 is shown as either green (no service required) or red (service required) based on the vehicle 102 service status. Daily activity log 405 displays events as they occur. The display retains two days, with the third day replacing the data for the oldest day.

Daily activity log 405 represents the user interface screen that will be monitored for activity occurring in the environment stabilization facility 103 or yards that are included in the environmental stabilization system 100 site configuration. An event is identified with Date/time stamp, the locally assigned Admin number of the asset, the model number, and other information that may be necessary for management. The environment stabilization facility 103 and door/gate where the event occurred is also listed. The Service Due light will turn red should a service be required on the asset or vehicle 102. By clicking on the red service button, the user can go to the screen that allows the user to enter data to correct the flag such as service date change, or schedule the service on the asset or vehicle 102.

Daily Activity Log 405 provides a brief summary that will allow a user monitoring vehicles 102 maintenance status from a remote location to know that a particular asset or vehicle 102 has departed environment stabilization facility 103, through which entrance/exit, and at what date and time. Also provided are the admin number, asset type, model, and Unit Identification Code (U IC). Service Due indicator 410 is updated based on the service due flag set during the check for services and is displayed as either red or green (red indicating services are due on the vehicle). In this manner, environmental stabilization system 100 allows a user (whether on-site or remotely located) visibility into the particular activity(ies) occurring.

When a new vehicle 102 or asset arrives at environment stabilization facility 103, it is manually assigned an Administration number and RFID Tag 109. This information is then manually entered into the maintenance database using site controller 101 to update the vehicle history information, including, but not limited to, mileage, engine hours, and last performed maintenance. Time-out-of-Shelter (TOS) is initialized to zero. The location status is set to "In - Shelter x I Door y" (or "Out - Shelter x / Door y", for vehicle 102 exit) based on vehicle 102 moving through the entry point and detection by portal antenna 108.

FIGS. 5 through 10 are preferred embodiments of certain other interactive status reports 300 provided by environmental stabilization system 100.

Figure 5:
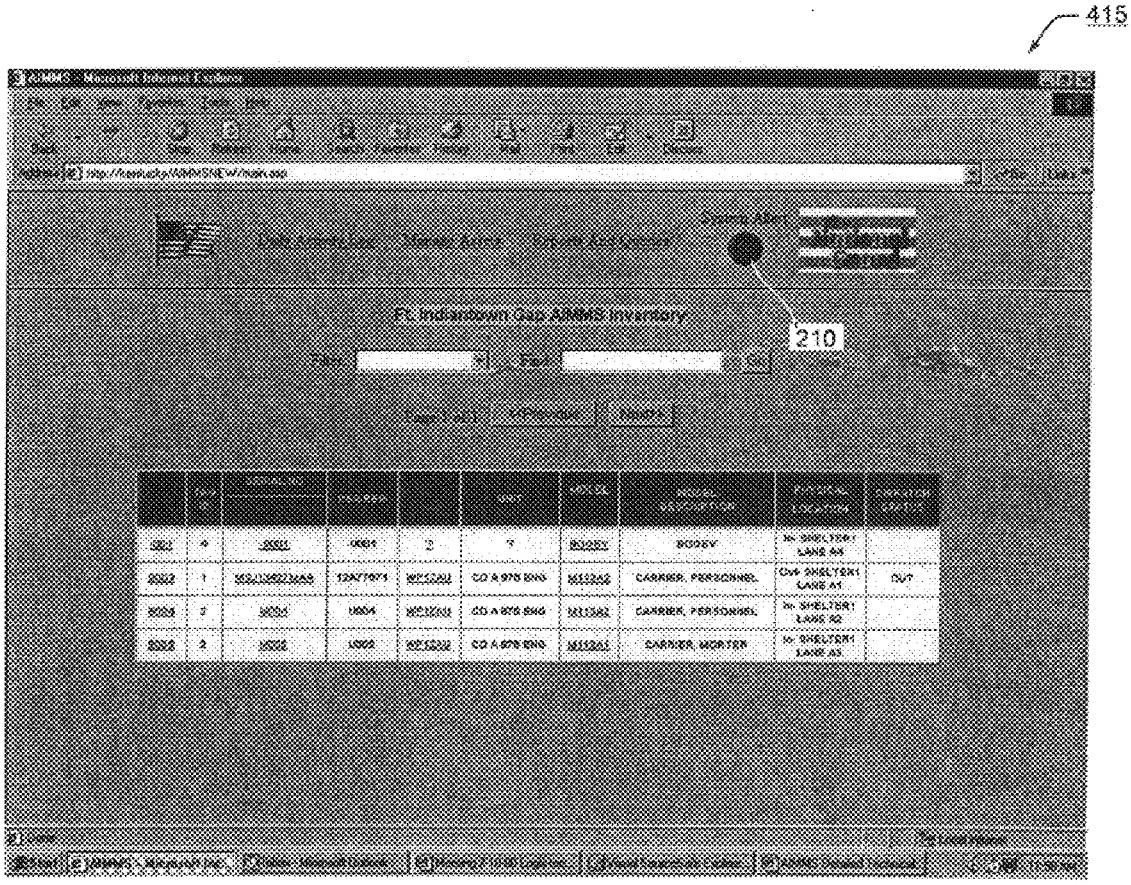
FIG. 5 is a preferred embodiment of an asset inventory report according to the present invention.

FIG. 5 is a preferred embodiment of an asset inventory report 415 that reflects the inventory rollup of assets or vehicles 102 contained in maintenance status database 125. This standard query also provides hyperlinks to other areas of the asset management features of environmental stabilization system 100. Environment stabilization facility 103 may have hundreds of assets or vehicles 102 that would provide the same information on each asset or vehicle 102. In order to isolate a single asset or vehicle 102, environmental stabilization system 100 provides for single asset or vehicle 102 selection and also a specific date range to further refine the displayed information.

Figure 6:
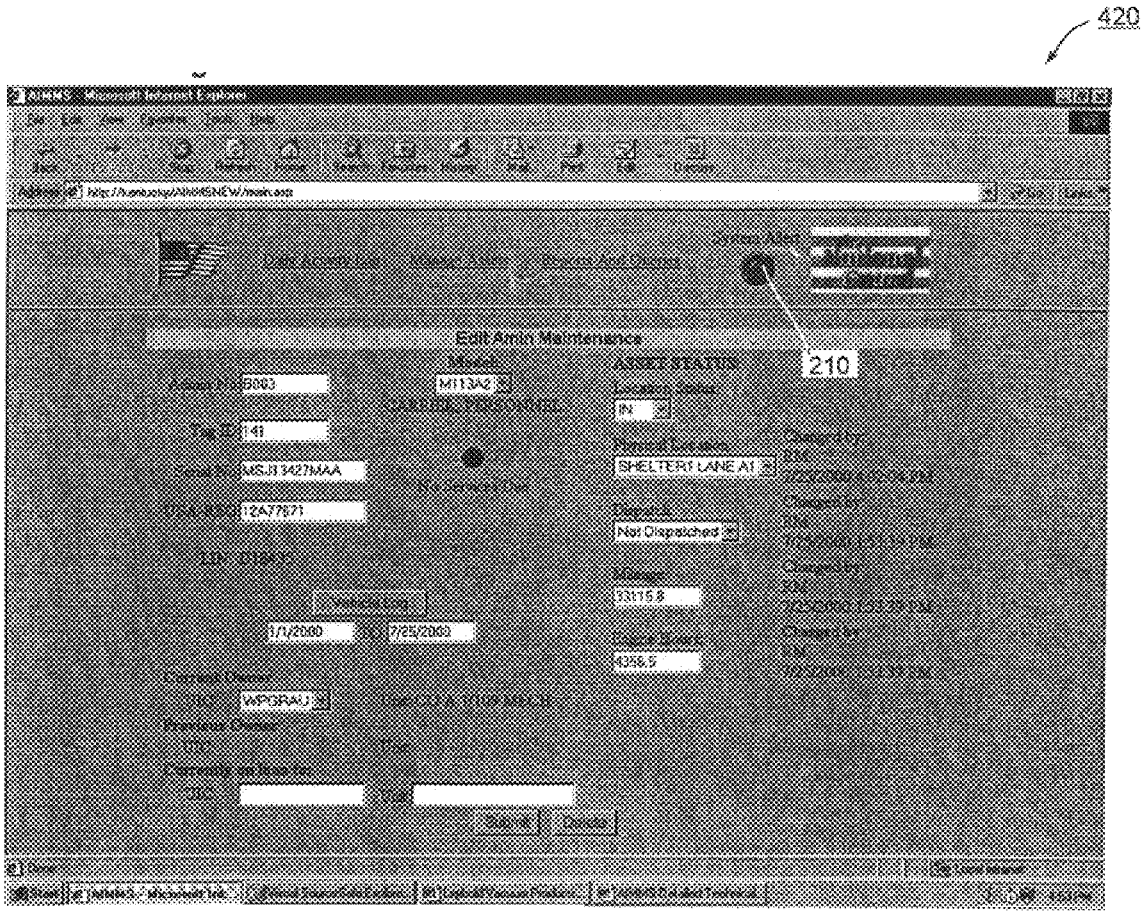
FIG. 6 is a preferred embodiment of an administrative report according to the present invention.

FIG. 6 is a preferred embodiment of an administrative report 420 that allows a user to enter data regarding an asset or vehicle 102, and change the data that may be incorrect. The user must authenticate the data points that are changed if they are critical to the system 100 operation. Administrative report 420 also provides an audit trail for assets or vehicles 102 that have been 151 transferred between units.

Figure 7:
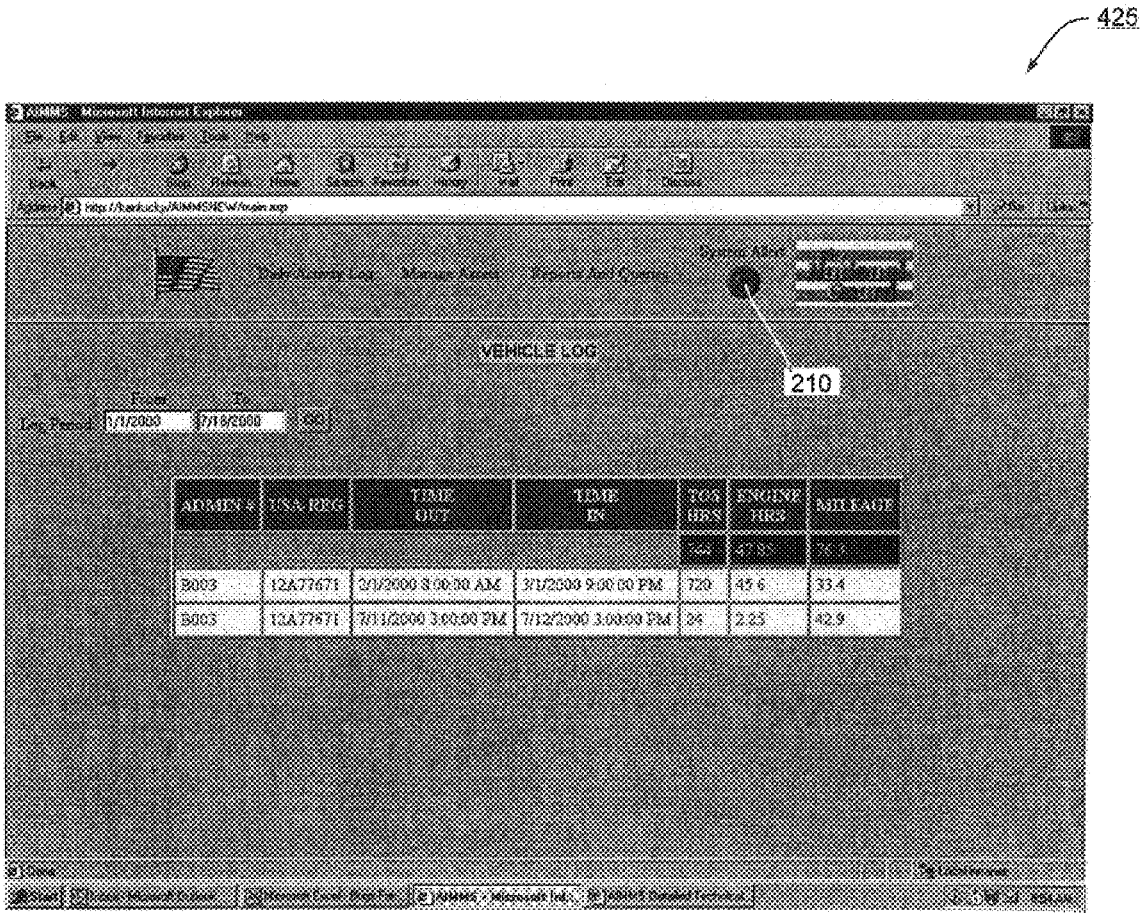
FIG. 7 is a preferred embodiment of a vehicle log according to the present invention.

FIG. 7 is a preferred embodiment of a vehicle log 425.

Figure 8:
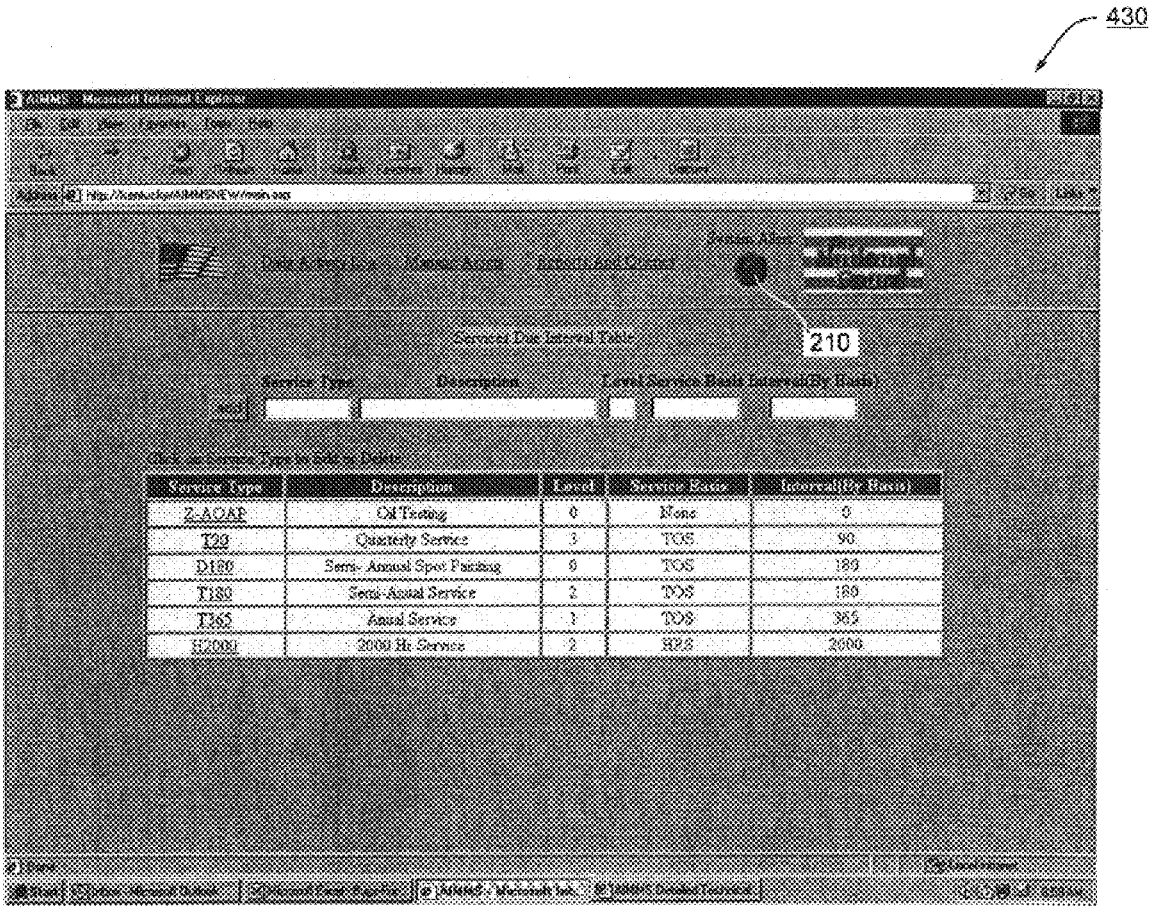
FIG. 8 is a preferred embodiment of a master maintenance interval table according to the present invention.

FIG. 8 is a preferred embodiment of a master maintenance interval table 430. Master services due interval table 430 allows a user to add/edit any service that may be required for any model vehicle 102 in the inventory. The services can be based on engine hours or miles, or may be identified in the Time Out of Shelter metric used specifically for controlled humidity preservation storage.

Figure 9:
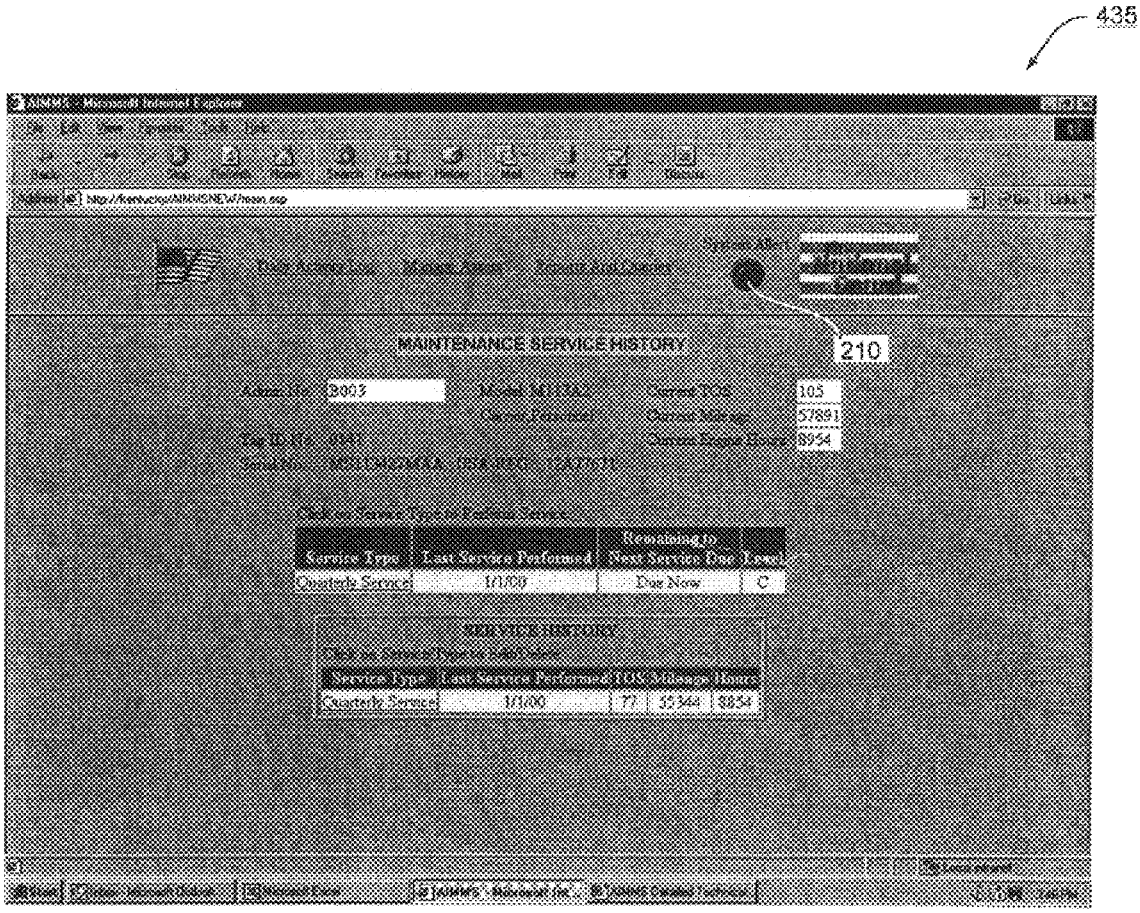
FIG. 9 is a preferred embodiment of a maintenance service history log according to the present invention.

FIG. 9 is a preferred embodiment of a maintenance service history log 435.

Figure 10:
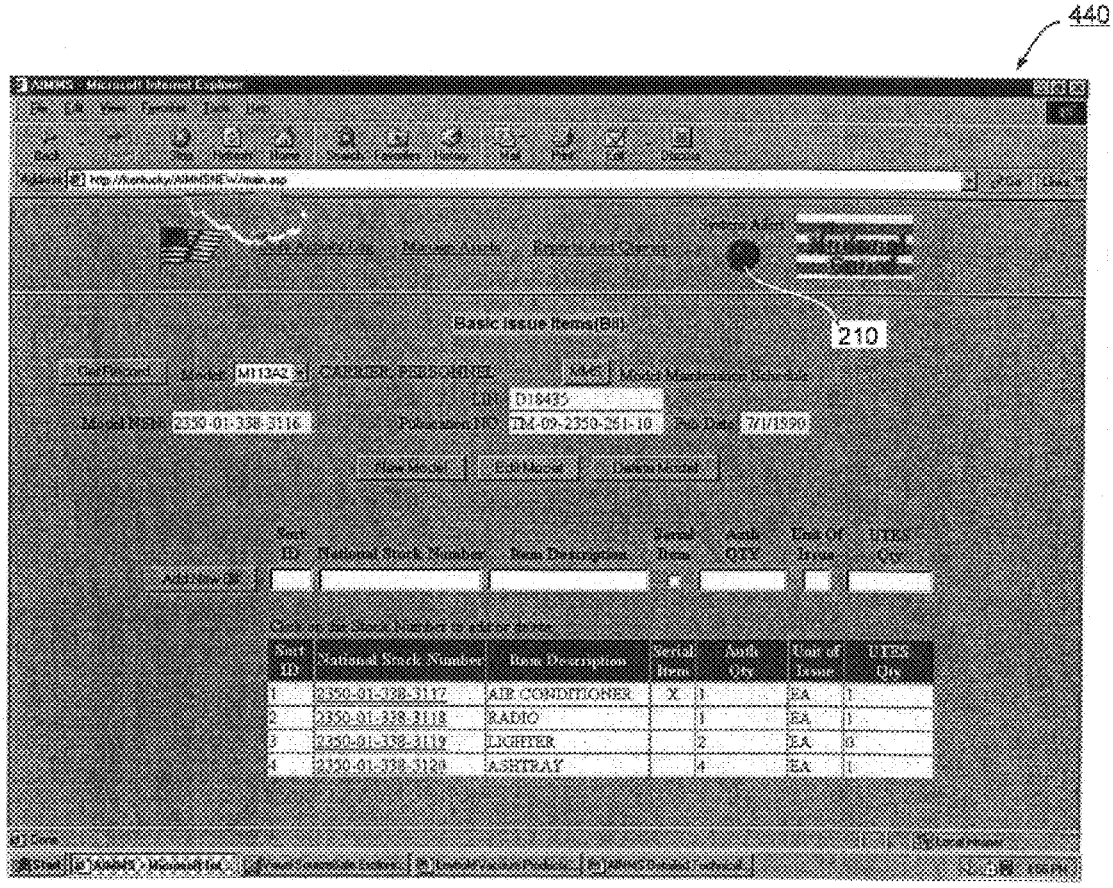
FIG. 10 is a preferred embodiment of a basic issue items log according to the present invention.

FIG. 10 is a preferred embodiment of a basic issue items list 440. Each item or vehicle 102 is listed on the top of the form, with the component items listed on the bottom. The list can be selected by the model number. The National Stock Number is a hyperlink to an accountable list for property control actions. For example, if one of the items or vehicles 102 were lost, the link would provide relevant data for a Statement of Charges to replace the lost item. The list can also be edited for additions or deletion from the list. Another interactive status report 300 is selectable to allow maintenance services to be added to the model.

Also provided is an online dispatch form (not shown) that is tailored to the environment stabilization facility 103. Such a form is useful when, for example, an asset or vehicle 102 is being dispatched for participation in a demonstration at a local airfield or the like. The purposes can be user defined and stored, such as weekend drills, Annual training and extended field exercises. The dispatch form allows for tracking whether the log sheets accompanied vehicle 102, an integral part of the asset control procedure.

Figure 15:
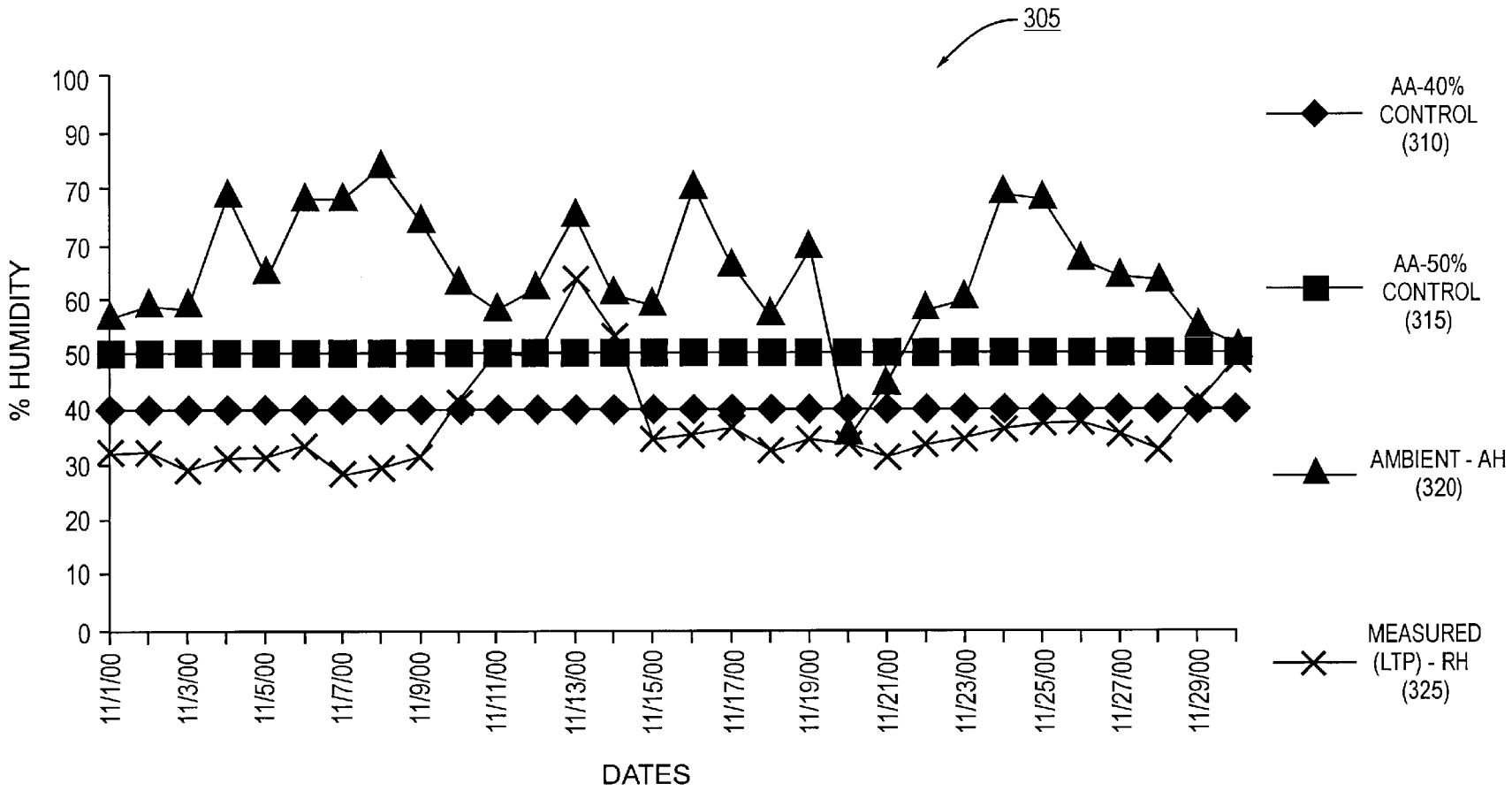
FIG. 15 depicts an example compliance report produced by a preferred embodiment of an environmental stabilization system according to the present invention.

FIG. 15 a portion of a monthly report generated by the MRS in a preferred embodiment according to the present invention. Referring now to FIG. 15, a compliance report 305 is produced by the MRS upon operator command. Compliance report 305 is produced by the MRS using the vehicle maintenance status contained in maintenance status database 125. Compliance report 305 is useful to verify that environmental stabilization system 100 has performed as required during a particular period of time. Vehicle maintenance status included in compliance report 305 includes environmental status information. Such environmental status information provided by exemplary compliance report 305 includes, but is not limited to, the ambient relative humidity value 320. Values 310 and 315 refer to the performance requirements. Value 310 is the control limit, and value 315 represents the 100% required compliance value. The actual measured value is represented at 325. Each of these values is represented by a point on a two-dimensional plane wherein the relative humidity level (expressed as a percentage) is specified (as the dependent axis) for a particular day (independent axis). In particular, compliance report 305 indicates whether or not environmental stabilization system 100 has maintained the relative humidity level within the atmospheric region of interest, as indicated by measured value 325, below the lower control limit 310. Compliance report 305 also provides an indication of the ambient relative humidity value 320 for particular days. Lower control limit 310 is set by operator command to desired values. In the exemplary compliance report 305 of FIG. 15, upper control limit 315 is set to 50% relative humidity, and lower control limit 310 is set to 40% relative humidity. Measured value 325 is the actual relative humidity level measured by an environmental sensor 104.

Compliance report 305 may also include log entries providing further information associated with the reported environmental conditions on a particular date. For example, referring again to FIG. 15, compliance report 305 may indicate that the elevated measured value 325 (relative humidity) on November 10–14 and November 29–30 was caused by a particular type of equipment failure.

FIGS. 17 and 18 show exemplary monthly and hourly process control charts 350 and 355, respectively, provided by a preferred embodiment of an MRS according to the present invention. Referring now to FIG. 17, charts 350 and 355 may also include a chronological listing of recent vehicle maintenance status.

Figure 11:
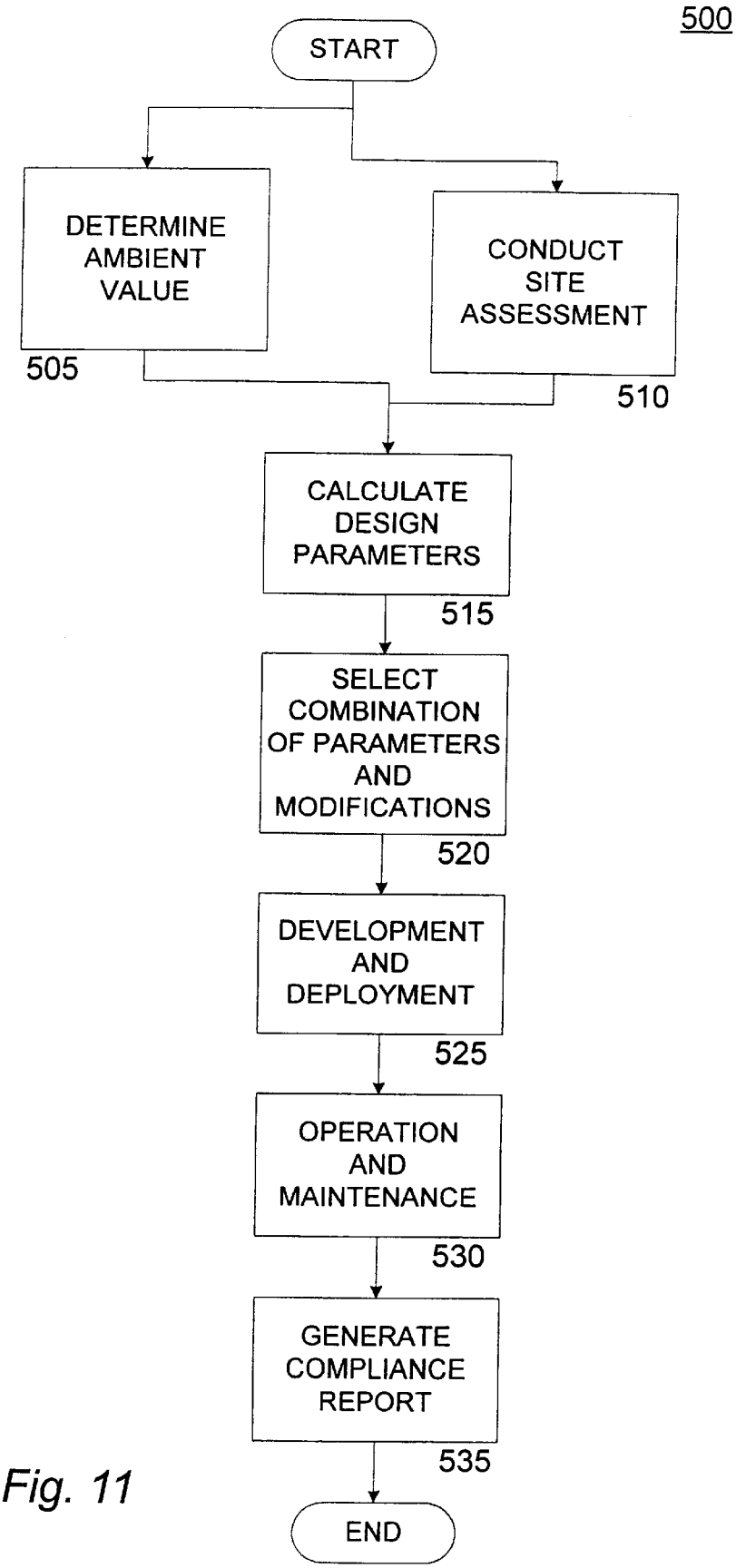
FIG. 11 is a flow diagram of a preferred method of achieving environmental stabilization according to the present invention.

FIG. 11 depicts a preferred method 500 for achieving and maintaining environmental stabilization for vehicles 102 stored in environment stabilization facility 103. Referring now to FIG. 11, in step 505, the ambient value of the relative humidity and temperature level present at environment stabilization facility 103 is determined, preferably, by obtaining the expected range of the variation in relative humidity and temperature from compiled sources of meteorological data for the geographical region in which the storage site is located. Preferably, 20-year records of historic relative humidity and temperature, and trends, are obtained from National Oceanic and Atmospheric Administration (NOAA) for this purpose. Alternatively, ambient value relative humidity and relative humidity and temperature information is determined by obtaining the expected range of the variation in relative humidity and temperature by measuring, over a period of several days during different seasons throughout the year, the relative humidity and temperature present at environment stabilization facility 103 using meteorological data collection equipment, such as a barometer and thermometer having a interface to a computer for automatic recordation and permanent storage of measured values. In either case, the method 500 according to the present invention includes calculating an average daily value of said relative humidity level and an expected annual range of variation of said relative humidity level, which is included as a statistical component of the ambient value.

Referring now to block 510, the method 500 according to the present invention includes conducting a site assessment to determine the presence or absence of site specific factors affecting the inherent ability of environment stabilization facility 103 to collect and remove heat from its interior region. Further, for those factors found to be present, the method 500 includes determining the extent of their influence upon the ability of environment stabilization facility 103 to collect and remove heat from its interior region. Specific factors analyzed include: The heat absorption rate of the materials used in the construction of environment stabilization facility 103, including the color of the exterior surfaces and exposure to direct sunlight as well as the ability of the building materials to transmit or radiate heat; the volume of the interior of environment stabilization facility 103; and the rate of air flow provided throughout environment stabilization facility 103 by air circulation facilities. The site assessment of step 510 also may include determining the availability of electricity and other utilities services to the storage site, as well as the water drainage capabilities of the site, availability of an adequate electrical ground signal plane, soil conditions, and local building codes. Site assessment may also include identification of any constraining requirements to use particular items of customer furnished equipment in the development, deployment, operation, and/or maintenance of environmental stabilization system 100.

Referring now to step 515, the method 500 according to the present invention includes calculating a preferred set of design parameters for an environmental stabilization system 100 based on the factors determined by site assessment step 510 and the ambient values determined from step 505. This step of calculating includes trading off prospective structural modifications and material modifications to environment stabilization facility 103 against the conditioned output able to be provided by various configurations of environmental stabilization system 100. For example, if there is no existing structure to be modified, use of metal versus fabric material in the construction of environment stabilization facility 103 is a design parameter. If an existing structure is to be converted to a environment stabilization facility 103, then the ability to adequately insulate existing doors, vents, windows, as well as any structural deficiencies is evaluated. As a further example, changing the exterior color of environment stabilization facility 103 from a high heat absorption color such as, for example, dark green to a less absorptive color such as, for example, light tan can be evaluated for purposes of reducing the heat absorption rate of environment stabilization facility 103, and, thereby, reducing the heat transmitted to the interior of environment stabilization facility 103 and the vehicles 102 located therein.

In another example, insulating material such as, for example, common household fiberglass insulation, can be mounted to the interior walls of environment stabilization facility 103 (or, an insulated compartment can be formed, using insulating material, within controlled preservation facility 103) such that the interior of environment stabilization facility 103 is substantially insulated from temperature changes occurring outside environment stabilization facility 103, thereby reducing the conditioning requirements for environmental stabilization system 100.

In another example, reflective material can be applied to the exterior walls and roof of environment stabilization facility 103 to reduce the heat absorbed by environment stabilization facility 103 and transmitted to the interior of environment stabilization facility 103 and the vehicles 102 located therein. This also reduces the air cooling range and rate of conditioning requirements for environmental stabilization system 100.

In another example, a floor liner may be used inside environment stabilization facility 103 to prevent ground moisture from contributing to the interior relative humidity level. In order to prevent puncturing or tearing of the floor liner by vehicle 102 movement, the floor liner is preferably located or buried at least 12 inches below the floor surface of environment stabilization facility 103. The floor liner edges are sealed to the interior side-walls of environment stabilization facility 103 using, for example, common flooring adhesive sealant.

Design parameters for environmental stabilization system 100 include: The number of air dehumidification units 110 to be used; the conditioned air output flow capacities of each air dehumidification unit 110; the locations of multiple air dehumidification units 110 within environment stabilization facility 103; redundancy of air dehumidification units 110 for fault tolerance; and, the power consumption required by environmental stabilization system 100 incurred to meet these design objectives.

More specific design parameters for environmental stabilization system 100 determined by method 500 in step 515 include:

a. Static Ambient Conditions Load —This average daily value of ambient relative humidity as determined in step 505, in which environmental stabilization system 100 must perform year round.

b. Static Infiltration Load —This parameter specifies the effect on the performance required of environmental stabilization system 100 due to leaks, or atmospheric heat and moisture conductance, between the interior and exterior regions of environment stabilization facility 103.

c. Permeation Static Load —This parameter specifies the effect on the performance required of environmental stabilization system 100 caused by the materials and composition of environment stabilization facility 103, and the ability of these materials to prevent moisture intrusion therein. This is determined by evaluating the vapor pressure gradients to be encountered between the interior and exterior regions of environment stabilization facility 103.

d. Ventilation Static Load —This parameter specifies the effect on the performance required of environmental stabilization system 100 caused by vents in environment stabilization facility 103.

e. People and Product Static Load —This parameter specifies the effect on the performance required of environmental stabilization system 100 caused by the moisture load-carrying capacity of items to be placed within environment stabilization facility 103, based on their composition.

f. Rapid Temperature Change Transient Load—This parameter specifies the effect on the performance required of environmental stabilization system 100 counteract transient moisture load conditions caused by rapid changes in the atmospheric temperature exterior to environment stabilization facility 103.

g. Opened Shelter Transient Load—This parameter specifies the effect on the performance required of environmental stabilization system 100 to counteract transient moisture load conditions caused by rapid changes in the atmospheric temperature exterior to environment stabilization facility 103 due to, among other things, environmental stabilization system 100 system shutdown, or opening of a doorway to environment stabilization facility 103 to permit ingress/egress of a vehicle 102.

In a preferred embodiment, these design parameters are input to a PC-based design calculation program that determines an expected range of the interior relative humidity value (interior of environment stabilization facility 103) and also an expected rate of change in the interior relative humidity value. Similar values are calculated for interior temperature. The design calculation program determines the extrema in the ranges of each of the above parameters, and adds the static parameters, to arrive at this determination. In a most preferred embodiment, the design calculation program then maps the thuscalculated expected range and expected rate of change to a set of potential air dehumidification unit 110 configurations for use in step 520. In a preferred embodiment, design calculation program selects from a set of stored identifiers for air dehumidification units 110 ranging in output capacity from 50 standard cubic feet per minute (SCFM) and 9000 SCFM. SCFM measures the cubic feet of dehumidified air that an air dehumidification unit 110 can produce in one minute. In a preferred embodiment, air dehumidification units 110 are capable of operation in an operational temperature range of −40° C. to +95° F. Each such configuration may be further modified by using ducting systems to control air dehumidification unit 110 output air distribution and direction.

Preferably, step 515 includes estimating the total lifecycle costs of making and maintaining any structural or material modifications, and of operating, staffing and maintaining environmental stabilization system 100, for various potential combinations of design parameters and modifications, each particular combination being effective to provide environmental stabilization as described herein.

Further, step 515 may include selecting the type of reactivation power source to be used by air dehumidification unit 110. Reactivation power sources include electric, gas, or steam. Selection of the reactivation power source may in turn affect the determination to operate air dehumidification units 110 in either open loop or closed loop mode.

This step 515 also includes design and location of the site controller 101, zone control module(s) 160, location of portal antennas 108 and environmental sensors 104, and capacity and routing requirements of networks 105, 106, 112 and 130, referring back to FIG. 1.

In a preferred embodiment, MRS is used to analyze the data determined, collected, and calculated in steps 505, 510, and 515, respectively, for proper fit in comparison to similar data associated with other applications or uses of environmental stabilization system 100 similar to the instant application under evaluation. Data determined, collected, and calculated for the instant application falling outside of the range established for that particular parameter are flagged for follow-up review (e.g., sanity check) to trigger revision if appropriate.

Referring now to step 520, a particular combination of design parameters and modifications is selected. In a preferred embodiment, the particular combination of design parameters and modifications that achieves environmental stabilization (without requiring a source of humidified air to be included with environmental stabilization system 100) at the lowest total lifecycle cost is selected for development, deployment and installation. Alternatively, factors other than cost are used as criteria for selecting a preferred combination. Such other factors may include, but are not limited to, increased environmental stabilization system 100 reliability and availability, and limitations on the structural or material modifications available due to mission requirements or location of environment stabilization facility 103.

Referring next to step 525, the method 500 according to the present invention includes development and deployment of an environmental stabilization system 100 according to the required design parameters of the selected combination from step 520. Development and deployment includes procuring required hardware components, customizing software application modules, populating databases with site-specific information required for data driven applications, installing the environmental stabilization system 100 components (such components including, but not limited to, those described herein), testing the installed environmental stabilization system 100 system, demonstrating to user personnel the operation and maintenance and of the installed system, and certifying operational readiness. This step 525 may also include pre-installation component and system testing of components, subcomponents, and subsystems comprising environmental stabilization system 100. In a preferred embodiment, no structural modifications are required to vehicles 102 to install environmental stabilization system 100. This step 525 may also include training of customer personnel in the operation of environmental stabilization system 100.

Referring now to step 530, the method 500 according to the present invention includes monitoring and controlling environmental stabilization system 100 as described herein, as required to maintain environmental stabilization for the vehicles 102 within environment stabilization facility 103. For certain applications, this step 530 may include providing contractor logistic support functions.

Referring now to step 535, the method 500 according to the present invention includes generating a compliance report 305 (shown in FIG. 15) using vehicle maintenance status contained in maintenance status database 125 at central processing facility 140.

In an alternative embodiment, the method 500 of the present invention includes subdividing environment stabilization facility 103 into multiple control zones. Each control zone may then be independently monitored and controlled by an associated zone control module(s) 160 and/or site controller 101. A user may monitor and change control parameters for each control zone using local stations 111 and monitoring station 107 or remote connections provided the software control application programs described earlier herein.

In another embodiment, instead of environmental stabilization being provided for vehicles 102 stored within a environment stabilization facility 103, environmental stabilization system 100 is provided in a single vehicle embodiment of environmental stabilization system 100. In this single vehicle embodiment, environmental stabilization is achieved for vehicles 102 present at storage site by monitoring and controlling the atmospheric conditions present throughout the interior region of each vehicle 102, while the environmental conditions exterior to vehicles 102 are uncontrolled. The single vehicle environmental stabilization system 100 configuration is useful for maintaining environmental stabilization for vehicles 102 stored outside an environment stabilization facility 103, such may be used at a forward deployment location for military equipment, equipment or containers.

In this single vehicle embodiment, a single vehicle ESS unit 150 is used to provide dehumidified air to the interior region of a vehicle 102. The output of single vehicle ESS unit 150 is connected to an open door or hatch, or other means of egress/ingress for vehicle 102, such that dehumidified air is conveyed to the interior of vehicle 102 in order to maintain environmental stabilization for the interior atmosphere of vehicle 102.

Figure 12:
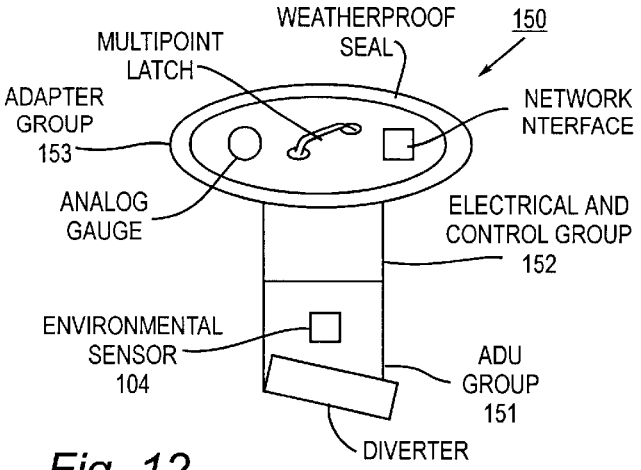
FIG. 12 is an assembly drawing of a preferred embodiment of a single vehicle environmental stabilization unit according to the present invention.

FIG. 12 shows a preferred embodiment of single vehicle ESS unit 150 according to the present invention. Referring now to FIG. 12, single vehicle ESS unit 150 includes an air dehumidification unit (ADU) group 151, an electrical and control group 152, and an adapter group 153. ADU group 151 includes a simple desiccant rotor dehumidification unit rated, preferably, at a capacity of 50 standard cubic feet per minute (SCFM), a conditioned air output diverter, and reactivation air inlet hood and hoses for ventilation. Air to be conditioned is drawn through the desiccant rotor. The desiccant absorbs moisture in the drawn air and the dehumidified air is forced out of the conditioned air output diverter into the vehicle 102 interior. ADU group 151 includes a second airflow for reactivation air. Reactivation air is drawn from either the interior or exterior of vehicle 102, heated by ADU group 151, passed across a portion of the desiccant rotor to remove the moisture deposited by the conditioned air, and expelled through a reactivation air outlet weather hood. ADU group 151 includes an environmental sensor 104 that constantly measures the interior atmosphere, specifically relative humidity, of vehicle 102.

In a first single vehicle embodiment, environmental sensor 104 transmits measurements to the electrical and control group 152 for display via analog gauge or other suitable display device. In this embodiment, electrical and control group 152 provides control signals to ADU group 151 to increase or decrease the temperature, flow rate, and dehumidification level of conditioned air provided to the interior of vehicle 102 in response to manually-controlled adjustment mechanisms including, but not limited to, rotary knobs or keypad entry means, located on the outer portion of single vehicle ESS unit 150.

In a second embodiment, electrical and control group 152 provides control signals to ADU group 151 to increase or decrease the temperature, flow rate, and dehumidification level of conditioned air provided to the interior of vehicle 102 in response to commands received from site controller 101 via local network 105. In this embodiment, electrical and control group 152 includes a processor and a transducer to translate digitally-encoded commands received from site controller 101 into desiccant rotor rotation speed commands, and conditioned air temperature heating commands. Further, electrical and control group 152 converts the temperature and relative humidity measurement information received from ADU group 151, translates the information into digital format, and transmits the digitally encoded measurement information to site controller 101. Site controller 101 monitors the measured temperature and relative humidity information received from each single vehicle ESS unit 150 for out-of-range conditions and generates an alert message upon detecting an out-of-range condition as described herein.

For either embodiment, electrical and control group 152 also provides electrical power distribution for single vehicle ESS unit 150. Preferably, single vehicle ESS unit 150 operates using 110 VAC single phase electrical power.

In an OP embodiment as discussed previously, environmental stabilization system 100 is installed outside of an environment stabilization facility 103 utilizing the same controls technology of the environment stabilization facility 103 and capable of integration of the site controller 101 based functions including RFID tracking using portal antennas 108 installed at exit and entry gates of the parking area where the vehicles 102 are stored. Environmental sensors 104 are placed in a "control" vehicle 102 which transmits to the zone control module 160 for routing dehumidified air into the interior spaces of vehicles 102, aircraft, equipment or containers. In such an embodiment, the dehumidification level of conditioned air provided to the interior of vehicle 102 is controlled and adjusted in response t o commands received from site controller 101 via local network 105. Further, zone control module 160 converts the relative humidity and temperature measurement information received from the environmental sensor 104, translates the information into digital format, and transmits the digitally encoded measurement information to zone control module 160 and/or site controller 101. Site controller 101 monitors the measured relative humidity and temperature information received from the "control" vehicle 102 for out-of-range conditions and generates an alert message upon detecting an out-of-range condition as described herein. In this OP embodiment, multiple vehicles are connected to the Operation Preservation configured environmental stabilization system 100 using a specially configured air distribution system that regulates the amount of dehumidified air in to each vehicle 102 in the system. The system may be configured to handle from two (2) to twenty (20) or more vehic les 102 by a single air distribution unit 110.

Figure 13:
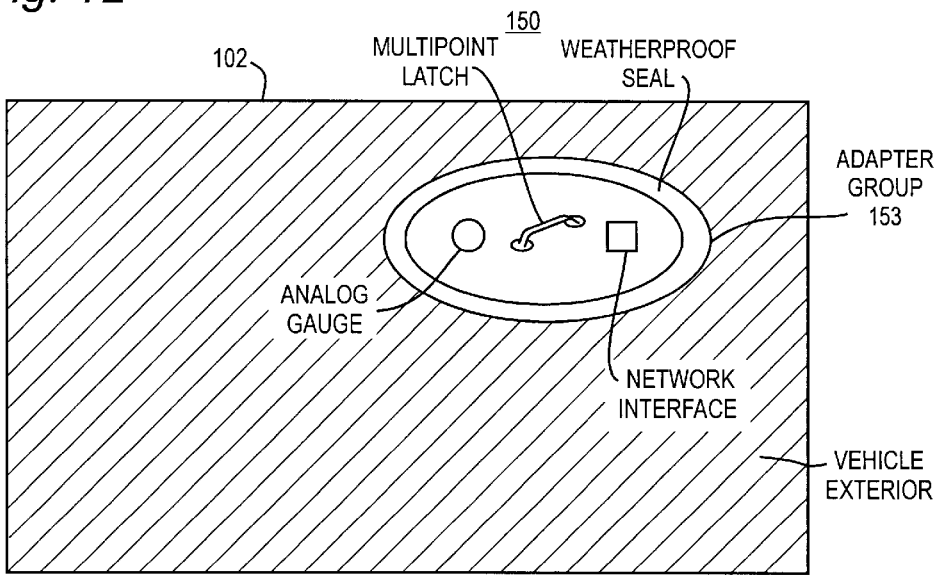
FIG. 13 depicts an exterior view of a preferred embodiment of a single vehicle environmental stabilization unit attached to a vehicle.
Figure 14:
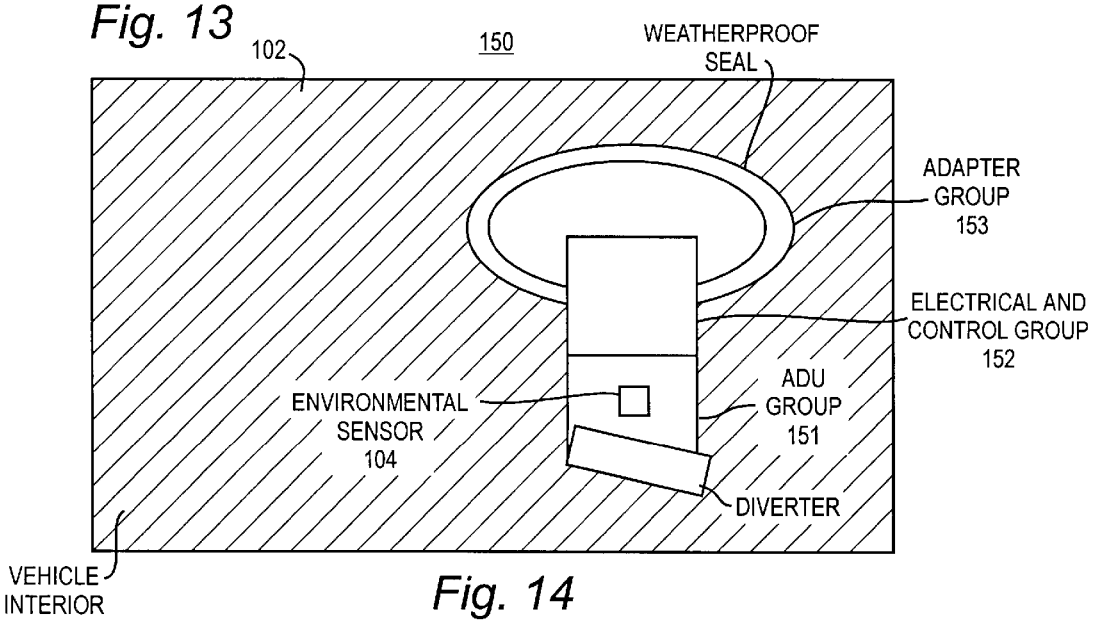
FIG. 14 depicts an interior view of a preferred embodiment of a single vehicle environmental stabilization unit attached to a vehicle.

In the Operational Preservation and single vehicle embodiments, an adapter group 153 or a vehicle, aircraft or container specific adapter is utilized to connect the air distribution system to the vehicle 102. In the case of the single vehicle ESS unit 150, adapter group 153, along with the other adapters utilized in operational preservation (OP), is specially adapted to provide a weatherproof seal with a door or hatch of vehicle 102 (including, but not limited to, aircraft, equipment or containers or other atmospheric conduit such as a gun muzzle or engine exhaust door), such that when attached to vehicle 102, single vehicle ESS unit 150 forms a weatherproof seal with the exterior of vehicle 102. In this way, conditioned air from the ADU 110 (in the case of operational preservation) or an ADU group 151 (in the case of the single vehicle ESS unit 150) is transmitted to the atmospheric interior of vehicle 102 with negligible atmospheric loss of conditioned air external to vehicle 102. Adapter group 153 preferably includes a multipoint latch that can be secured in the sealed position using an ordinary padlock. FIGS. 13 and 14 show an exterior and interior view, respectively, of single vehicle ESS unit 150 sealingly attached to a vehicle 102. Installation of adapter group 153 or operational preservation adapters do not require structural modifications to vehicle 102 and are easily disconnected.

Thus, an environmental stabilization system and method has been shown that provides environmental stabilization of the atmospheric conditions experienced by stored equipment, and that provides electronic remote automated control and monitoring of environmental conditions as well as further providing remote monitoring and alerting of changes in equipment maintenance and availability status.

While the above description is set forth in specific detail, these details should not be construed as limitations on the scope of the invention, but rather as an exemplification of preferred embodiments thereof. Other variations are possible, including embodiments that include or exclude certain of the individual components described herein, or in which these components are set forth in different arrangements. Accordingly, the scope of the present invention should be determined not by the embodiments illustrated above, but by the appended claims and their legal equivalents.

We claim:

1. A business method for maintaining environmental stabilization for a plurality of vehicles, comprising the steps of:

determining an ambient value of a relative humidity level present throughout the atmosphere within an interior portion of a storage site used for storing said plurality of vehicles, said ambient value including an average daily value of said relative humidity level and an expected annual range of variation of said relative humidity level;

determining a set of design parameters for an environmental stabilization system capable of regulating said relative humidity level, said design parameters based on said ambient value;

remotely controlling said environmental stabilization system from at least one remote monitoring station, said remote monitoring station communicating with said environmental stabilization system using an electronic network;

regulating said relative-humidity level, using said environmental stabilization system and said remote monitoring station, such that said relative humidity level is maintained within a preferred range throughout the atmosphere within said interiorportion of said storage site;

maintaining battery readiness for each said vehicle using a battery preservation power system;

collecting maintenance status information for each said vehicle using a radio frequency identification system, said radio frequency identification system including a portal antenna and communicating electronically with a site controller;

transmitting an alert indication to said remote monitoring station using said electronic network in response to a change in vehicle maintenance status, said alert indication used to inform service personnel of said change in said vehicle maintenance status; and transmitting vehicle maintenance status to a central processing station.

2. The method of claim 1, wherein said step of remotely controlling said environmental stabilization system further comprises the steps of:

subdividing said interior portion of said storage site into a plurality of control zones; and independently controlling each one of said control zones using said remote monitoring station.

3. The method of claim 1 wherein said preferred range is between 30% and 40% relative humidity.

4. The method of claim 1, wherein said step of determining a set of design parameters further comprises the steps of:

identifying one or more structural modifications to an environment stabilization facility operable to modify said ambient value; and selecting a combination of said structural modifications and said design parameters to achieve said preferred range, said preferred range achieved by said environmental stabilization system acting in cooperation with said structural modifications, and said combination being operable to maintain said relative humidity level within said preferred range without adding humidified air to said interior portion of said storage site.

5. The method of claim 1, wherein said step of regulating said relative humidity level further includes the step of regulating atmospheric temperature present throughout the atmosphere within said interior portion of said storage site.

6. The method of claim 1, wherein said environmental stabilization system further includes one or more zone control modules operable to accomplish said step of regulating said relative humidity value.

7. The method of claim 1, wherein said step of regulating said relative humidity level further includes the step of regulating atmospheric temperature present throughout the atmosphere within said interior portion of said storage site.

* * * * *